US011125055B2

(12) United States Patent
Hernandez

(10) Patent No.: US 11,125,055 B2
(45) Date of Patent: Sep. 21, 2021

(54) EXTERNAL TRAP APPARATUS AND METHOD FOR SAFELY CONTROLLING TOOL STRING ASSEMBLIES

(71) Applicant: Michael Hernandez, Inez, TX (US)

(72) Inventor: Michael Hernandez, Inez, TX (US)

( * ) Notice: Subject to any disclaimer, the term of this patent is extended or adjusted under 35 U.S.C. 154(b) by 615 days.

(21) Appl. No.: 15/952,692

(22) Filed: Apr. 13, 2018

(65) Prior Publication Data

US 2018/0347318 A1 Dec. 6, 2018

Related U.S. Application Data

(63) Continuation-in-part of application No. 15/120,714, filed as application No. PCT/US2014/071431 on Dec. 19, 2014, now Pat. No. 10,597,980.

(60) Provisional application No. 62/088,767, filed on Dec. 8, 2014, provisional application No. 61/919,727, filed on Dec. 21, 2013, provisional application No. 62/485,087, filed on Apr. 13, 2017.

(51) Int. Cl.

| | |
|---|---|
| ***E21B 41/00*** | (2006.01) |
| ***E21B 19/10*** | (2006.01) |
| ***E21B 19/06*** | (2006.01) |

(52) U.S. Cl.

CPC ..... *E21B 41/0021* (2013.01); *E21B 19/06* (2013.01); *E21B 19/10* (2013.01)

(58) Field of Classification Search

CPC ..... E21B 41/0021; E21B 19/06; E21B 19/10
See application file for complete search history.

(56) References Cited

U.S. PATENT DOCUMENTS

| | | | | |
|---|---|---|---|---|
| 3,748,702 A * | 7/1973 | Brown | E21B 19/10 | 188/67 |
| 3,965,987 A * | 6/1976 | Biffle | E21B 21/01 | 166/379 |
| 5,167,277 A * | 12/1992 | Evans | E21B 21/01 | 166/81.1 |
| 5,310,007 A * | 5/1994 | Parikh | E21B 19/006 | 166/355 |
| 2008/0017371 A1* | 1/2008 | Khehra | E21B 44/00 | 166/250.01 |

* cited by examiner

*Primary Examiner* — Christopher J Sebesta
(74) *Attorney, Agent, or Firm* — M. Susan Spiering; Ochoa & Associates, P.C.

(57) ABSTRACT

An improved external trap apparatus 570 and a method for safely controlling drilling tool string components during oil field drilling operations includes a collar clamp 72 affixed to a drilling tool string lubricator 80 and configured with laterally spaced first and second vertical rails 120, 122 depending therefrom. Lubricator 80 also carries a lubricator clamp assembly 572 which is affixed to Lubricator 80 with inward clamping surfaces defining a non-circular or slightly elliptical central bore 574. Laterally spaced first and second vertical rails 120, 122 are configured to support a reinforced catcher plate assembly 164 carrying a tool-end receiving funnel receptacle 202 and first and second energy absorbing crush cylinders 160, 162. When the drill string 82 is raised or withdrawn from the well 28, the funnel receptacle 202 can be rotated into coaxial alignment to catch the drill string's end or downhole tool, in the event of an inadvertent loss of control of the drill string 82.

12 Claims, 23 Drawing Sheets

Section D-D

Detail 2

Detail 1

Section A-A

Detail A

Section B-B

Section A-A

EXTERNAL TRAP APPARATUS AND METHOD FOR SAFELY CONTROLLING TOOL STRING ASSEMBLIES

PRIORITY CLAIMS AND CROSS-REFERENCE TO RELATED APPLICATIONS

This application is a Continuation-In-Part of and claims priority to commonly owned, copending U.S. application Ser. No. 15/120,714 which was filed on 22 Aug. 2016 (entitled "External Trap Apparatus and Method for Safely Controlling Drill String Assemblies") and also claims priority to commonly owned U.S. provisional patent application 62/485,087 which was filed on 13 Apr. 2017 (entitled "Improved External Trap Apparatus and Method for Safely Controlling Drill String Assemblies"). This application is also related to commonly owned (a) application number PCT/US14/71431, filed 19 Dec. 2014, published in English as WO 2015/095668 on 25 Jun. 2015, (b) U.S. provisional patent application 62/088,767 filed 8 Dec. 2014 (entitled "External Trap Apparatus and Method for Safely Controlling Drill String Assemblies") and (c) U.S. provisional patent application 61/919,727 filed 21 Dec. 2013 (entitled "External Trap for Drilling Tool Strings") the entire disclosures of which are expressly incorporated herein by reference.

BACKGROUND OF THE INVENTION

Field of the Invention

The present invention relates to equipment for use in drilling and finishing hydrocarbon recovery wells, to drill and tool string apparatus, to drilling methods and, more particularly, to safety mechanisms and methods for the prevention of damage due to an unintended release of a well drilling tool, drill string, tool string, or like equipment used at a wellhead site.

Discussion of the Prior Art

As is known in the art, the recovery of oil or other hydrocarbons from underground is commonly accomplished by means of a borehole 30, or well, which is drilled to reach a deposit (see, e.g., FIGS. 1A and 1B). Drilling operations typically use a directional boring tool having a cutting head 34 which incorporates drilling controls in communication with drilling controllers at the surface. The cutting head is threadedly attached to the distal end of a hollow drill rod or drill pipe which consists of various downhole components, including, for example, a bent sub for directional control, as well as an elongated string (e.g., 36) of steel drill pipe segments threadedly connected end-to-end, with each segment typically being ten (10) meters in length. Rotational motion may be imparted to the drill head by a downhole hydraulic motor or by rotating the drill string from the earth's surface to drive the boring tool with its cutting head and attached bit.

As is known, as the drill bit is rotated, a suitable drilling fluid, or mud, is pumped downwardly inside the hollow drill string and exits out of the cutting head, flowing out around the bit and upwardly in the drilled well in the annular space around the outside of the drill string 36 to transport material loosened by the bit upwardly and out of the borehole 30 at the well head. As the bit advances down the borehole, sections of drill pipe are added to the surface or proximal end of the drill string assembly to gradually lengthen it during the drilling.

Conventional directional drilling allows the borehole 30 to be drilled to great depths, or to be directed downwardly and then horizontally away from the well head to reach the deposits being sought. As the well is drilled, a suitable casing is installed to preserve the integrity of the borehole. Periodically, the drill bit and cutting head are withdrawn from the borehole for servicing or to permit various tools such as surveying equipment to be inserted into the well, and in such a circumstance the sections of drill pipe are disconnected sequentially as the string is lifted out. Upon completion of the drilling and casing operation, it is often necessary to finish the well, as by perforating the well casing at the location of the hydrocarbon deposit, to allow fluid communication between the producing formation and the interior of the well casing. Perforations are usually formed using a tool or tool string incorporating a perforating gun loaded with shaped charges. The gun is lowered into the well, for example by means of a wireline, and the gun is activated to detonate the shaped charges to perforate the casing and to allow fluids to flow from the formation into the production well. Perforating guns are only one example of the downhole tools that may be inserted into the well. An example of such a perforating system is described in U.S. Pat. No. 6,779,605, which is directed to a system for controlling the activation of a downhole tool.

The installation and removal of various drilling tools in a well or borehole 30 involves the use of heavy drilling tool strings suspended, for example, by wirelines or by cables 58 which must be raised and lowered during drilling operations. The weight of such equipment poses serious safety issues, for the cable 58 holding a tool string 36 can break or be disconnected because of defective materials, operator error, or for other reasons. Falling tool strings (e.g., 36) not only can cause serious and costly damage to drilling equipment as well as significant delays in the drilling operation, but can cause serious injury and death to oilfield workers. For this reason, tool string housings are suspended separately from the tool strings and are frequently provided with an internal "tool trap"; that is, a mechanism to catch accidentally released tool strings to prevent them from falling.

Such internal tool traps suffer from two significant drawbacks: (1) they do not cushion the impact of a falling tool string on the trap mechanism, potentially damaging the tool, and (2) they are ineffective when the tool string is lowered below the position of the trap in the housing, as happens during inspection of the tool string. It is therefore desirable that an improved tool trap be designed to address these issues.

A typical contemporary drill string assembly is illustrated in U.S. Pat. No. 8,534,382 to VanPelt et al, which provides nomenclature for and illustrates the components needed to support and rotate a drill string during drilling. A number of other patents describe tools, stabilizers and control systems for protecting drill strings, including U.S. Pat. No. 3,949,150 to Mason et al, U.S. Pat. No. 6,408,948 to Fontana et al and U.S. Pat. No. 7,392,861 to Fouillou et al, all of which are incorporated herein by reference for understanding the state of the art and the relevant nomenclature.

None of the above cited references or patents, alone or in combination, address the safety issues encountered by oil field workers, particularly when a tool or a tool string (e.g., 36) is being raised and lowered by a conventional wireline, as happens during installation or inspection of the tool string.

Thus, there is an unmet need for an apparatus and a method for safely controlling drill string components during drilling operations so that when a downhole tool or tool string which is supported on a drill string, on a wireline, or on some other support mechanism is raised or withdrawn from the well, the tool supported on the distal end of the support mechanism will be prevented from falling uncontrollably if an inadvertent loss of control of the support mechanism occurs. More particularly, there is a need for a tool trap that meets the needs for safety outlined above.

SUMMARY OF THE INVENTION

Accordingly, it is an object of the present invention to overcome the above mentioned difficulties by providing an apparatus and a method for safely controlling drill string components during drilling operations so that when a tool is being inserted into a borehole, or is being raised or withdrawn from it, the distal end of the drill string or any downhole tool will be caught or trapped in an impact dampening funnel receptacle and be kept from falling uncontrollably if an inadvertent loss of control of the drill string occurs.

Another object of the invention is to provide an external tool trap that will catch unintentionally released tools in a cushioned manner that dissipates the kinetic energy of the falling equipment in such a way that any damage to tools, or the tool trap itself, as well as nearby people and equipment, is minimized.

Briefly, the apparatus and method of the present invention provide an improved tool trap which can be attached to the outside of a lubricator or other tool or tool string housing so that the end of tool string can be lowered past the housing for inspection with the tool trap in place to prevent damage that can be caused by an unintended release of the tool or the drill string. This external drill string trap assembly comprises a collar clamp having laterally spaced first and second vertical rails depending therefrom, the collar clamp being securable to the tool string housing. First and second energy absorbing crush cylinders are affixed to corresponding bottom ends of the first and second vertical rails, and an openable and closable catcher plate assembly is pivotally mounted on the rails in alignment with the housing. A tool-end receiving funnel receptacle is positioned on the catcher plate assembly, and is movable into coaxial alignment with the drill string housing when the catcher plate assembly is closed to receive any falling equipment and to transfer the kinetic energy of the equipment to the crush cylinders. The assembly further includes a lubricator clamp assembly defining a non-circular or slightly elliptical central bore mounted on the lubricator or housing and between the rails below and coaxially aligned with the drill string housing, and a debris shield surrounds the funnel receptacle when the catcher plate assembly is closed.

In greater detail, a tool trap assembly of the present invention is configured to arrest and cushion a falling drilling tool string includes a top attachment ring which fastens the device to the lower end of a lubricator or other tool string housing. At its bottom, the tool trap assembly incorporates a stopping, or fall arresting, cup-shaped funnel member which is attached to and supported by the top attachment ring by way of a pair of vertically extending connecting rods. The lower portions of the connecting rods extend beyond the tool string housing to enable the stopping member to be positioned below the housing. The stopping member includes pivotable plates which can be closed into a blocking position below the housing to prevent a tool or drill string segment from falling past the stopping cup-shaped funnel member, and which can be opened to permit the tool or drill string segment to pass freely through the tool trap.

A corresponding one of a pair of crush cylinders is disposed between the closeable stopping means and the lower end of each connecting rod, in such a way that the kinetic force generated by the impact of a tool string or a drill string segment falling on the closeable stopping member will be absorbed by the crush cylinders. The tool trap assembly can thus be fastened to the lower end of a lubricator or other tool or drill string housing so as prevent injury or damage from unintended or accidental tool or drill string releases, while still permitting the end of the tool string to be lowered past the housing for inspection or installation externally of the housing.

The invention is further directed to a method for catching the end of a tool string located in a housing for a drilling rig in the event of an inadvertent loss of control of the string, for example when inspecting or servicing the tool. The tool string may be positioned for axial vertical motion through a vertical housing such as a lubricator, and the method includes locating an openable and closable catcher plate assembly below the housing, opening the catcher plate assembly to permit insertion of the tool string into a well through the housing, or closing the catcher plate assembly to prevent the tool string from passing through and out of the housing. The method includes dissipating kinetic energy produced by loss of control of the tool string when the string strikes a closed catcher plate assembly, with the energy being absorbed by mounting a crushable energy absorbing material to the catcher plate assembly.

BRIEF DESCRIPTION OF THE DRAWINGS

The above and still further objects, features and advantages of the present invention will become apparent upon consideration of the following detailed description of preferred embodiments thereof, particularly when taken in conjunction with the accompanying drawings, wherein like reference numerals in the various figures are utilized to designate like components, in which.

DETAILED DESCRIPTION OF PREFERRED EMBODIMENTS

Figure 1A:
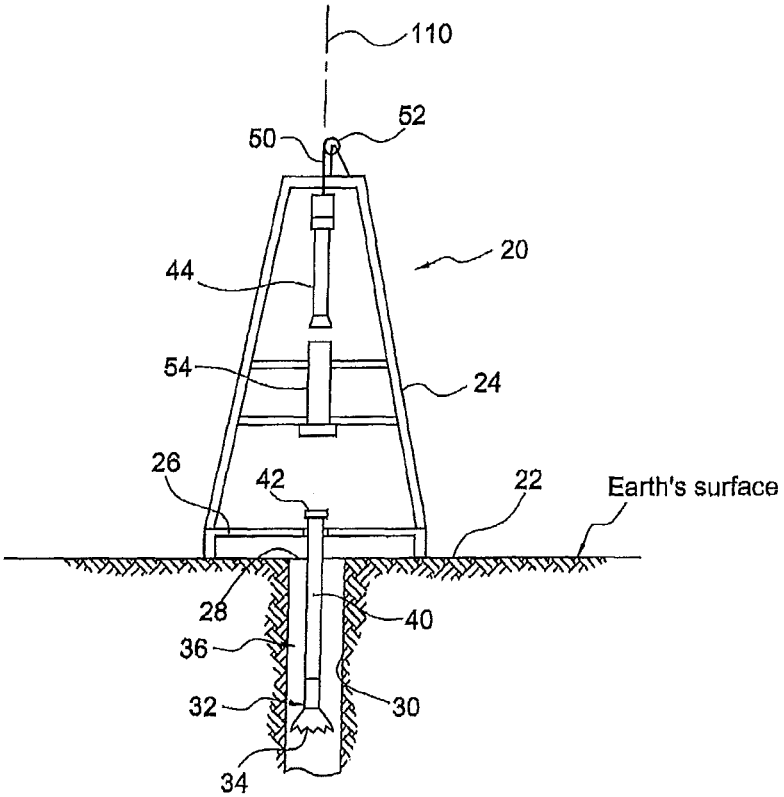
FIG. 1A PRIOR ART
FIG. 1A diagrammatically illustrates a prior art drilling rig having a drill string support structure in accordance with the prior art.
Figure 1B:
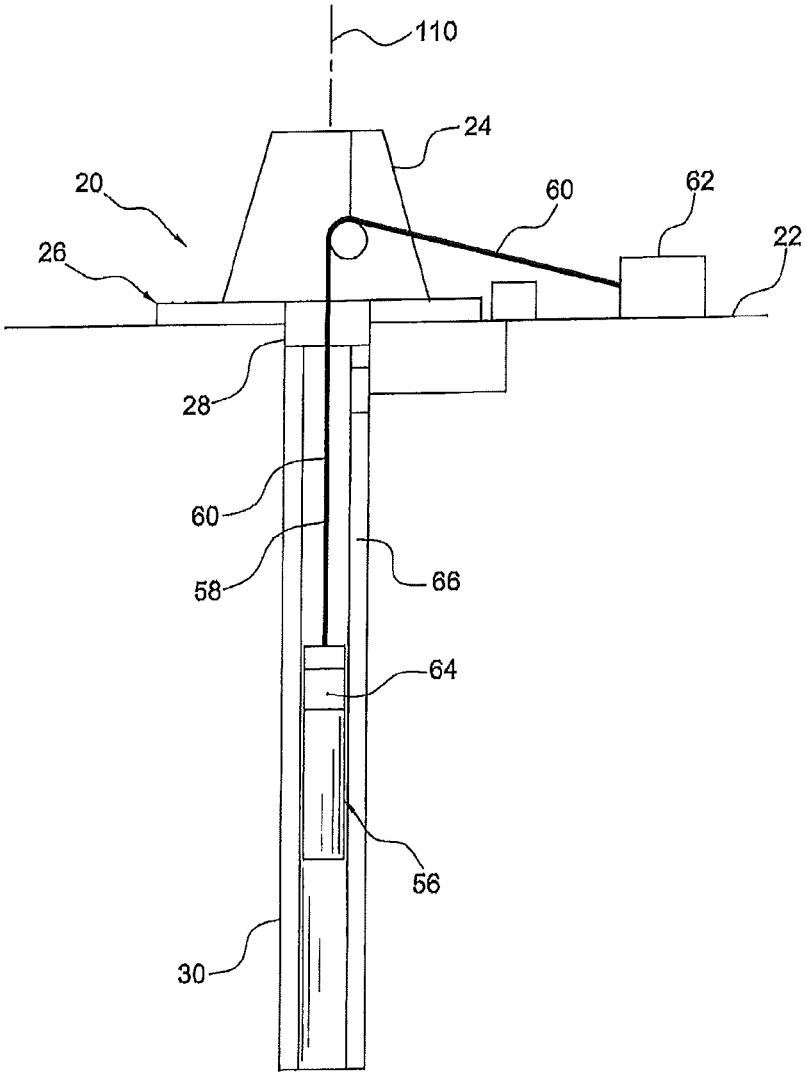
FIG. 1B PRIOR ART
FIG. 1B is a diagrammatic illustration of a prior art drilling rig having a wireline-supported downhole tool, which may be a casing perforating tool or tool string.

As illustrated at 20 in FIGS. 1A and 1B, it is known in the prior art to provide at a well drilling site 22 a drilling support structure which may be diagrammatically illustrated by a derrick 24 having a platform 26 at a wellhead 28 for the borehole 30 being drilled. As is conventional, during a drilling operation a drilling tool 32 —having a drill head and bit 34 is supported in the borehole by a drill string 36 made up of hollow steel pipe segments 40 connected end to end by suitable threaded fittings, as illustrated diagrammatically by threads 42 at the upper end of segment 40. Suitable drive motors either at the surface or at the drill head, and controls (not shown) which may be mounted on platform 26, drive the drill bit, for example by rotating the drill string 36 from the surface or by rotating the bit by a hydraulic motor in the drill head, to advance the drilling tool assembly down the borehole. Directional control of the drilling is obtained in known manner, as by the use of a bent sub at the lower end of the drill string.

Periodically, additional segments 44 are threaded onto the near end of the drill string 36 to allow the drill head to reach desired depths in the earth. The additional segments 44 are supported on the derrick, moved into place over the existing string in the well, and are lowered, as by a crane or by a suitable cable or chain 50 and a winch 52 through a guide housing 54 that is secured to the derrick and aligned vertically with the well head.

FIG. 1B illustrates a prior art well drilling site 22 wherein the drill string 36 has been lifted out of the well to allow insertion of a downhole tool or tool string 56 carried by a suitable support mechanism such as a drill pipe, coiled tubing, slick line, cable, wireline or the like, illustrated at 58 and supported on the derrick. For convenience of reference, the component 58 will be referred to herein as a wireline. As known, a wireline may incorporate conventional telemetry lines 60 connected to a surface controller 62 and to downhole controls 64 on the tool 56. In this illustration, the well 30 is shown as incorporating a casing 66.

As is known, downhole tools are inserted into or withdrawn from wells using an overhead support such as a crane. The tool 56 may take a variety of forms, as, for example, a well casing perforator utilized in finishing a well, as discussed above, but will for convenience herein be referred to as a well tool or tool string. Such a tool may consist of, for example, several five-foot long tool sections that are lowered into a well which may be vertical or may be diagonal or even horizontal. In the latter cases, the tool will slide along the internal surface of the well casing as it is being inserted, and thus usually requires lubrication before it enters the well bore. However, even when lubricated the tool may get stuck in the well, requiring a large tensile force to remove it. This force may damage the wireline or support fittings, and this can cause failures and dropped tools at the surface, endangering workers and equipment.

Figure 2A:
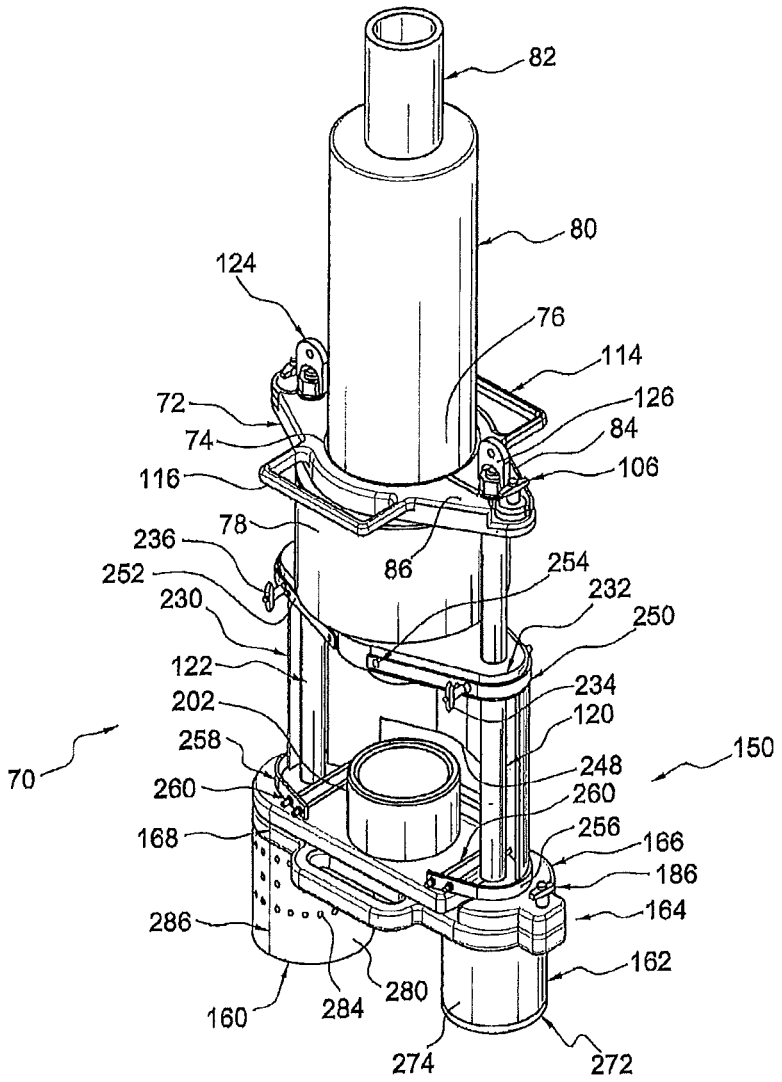
FIG. 2A illustrates a rear perspective view of a preferred embodiment of a tool catcher mounted on, and externally of, a safety housing, in accordance with the present invention.
Figure 2D:
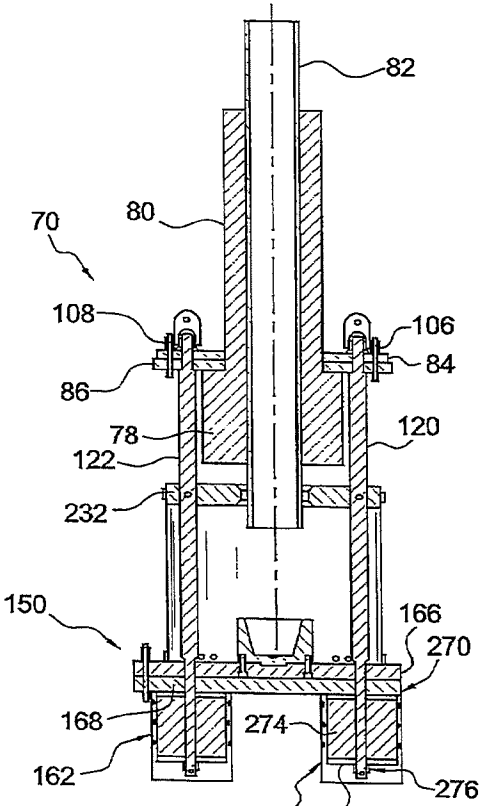
FIG. 2D is a sectional view taken along line D-D of FIG. 2C.
Figure 2C:
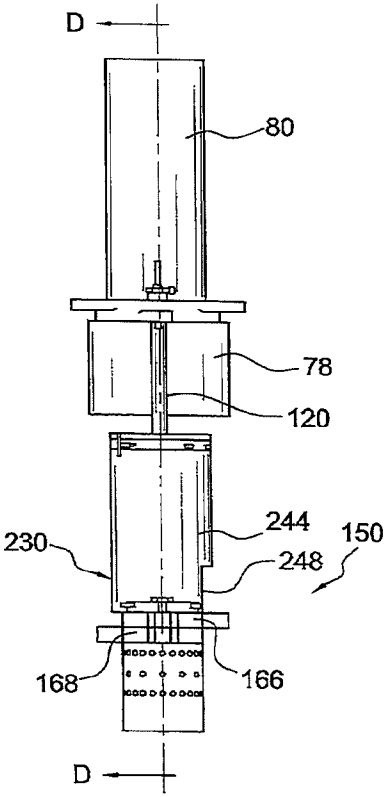
FIGS. 2B and 2C are front and side elevations of the tool catcher of FIG. 2A.
Figure 2B:
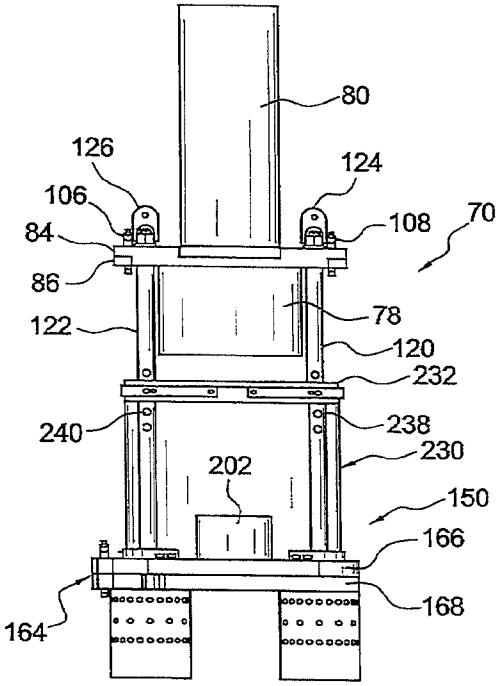
Figure 2E:
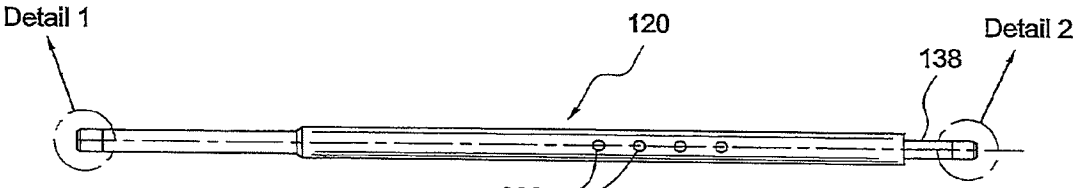
FIGS. 2E-2G are detailed views of portions of the tool catcher of FIG. 2A.
Figure 2G:
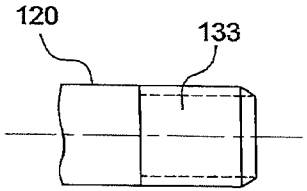
Figure 2F:
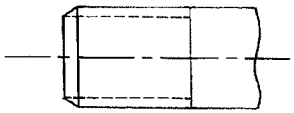
Figure 2H:
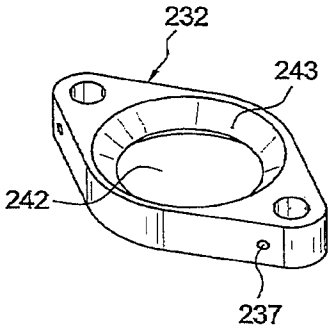
FIGS. 2H-2J are perspective, top plan and sectional views of an entry guide plate for the tool catcher of FIG. 2A.
Figure 2I:
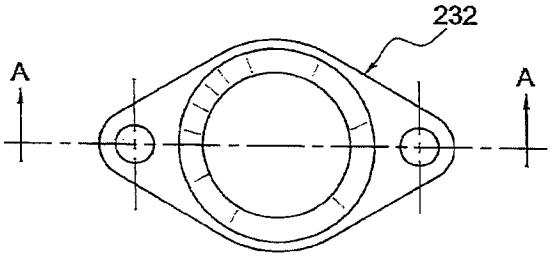
Figure 2J:
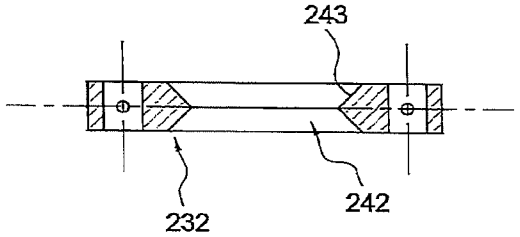
Figure 3:
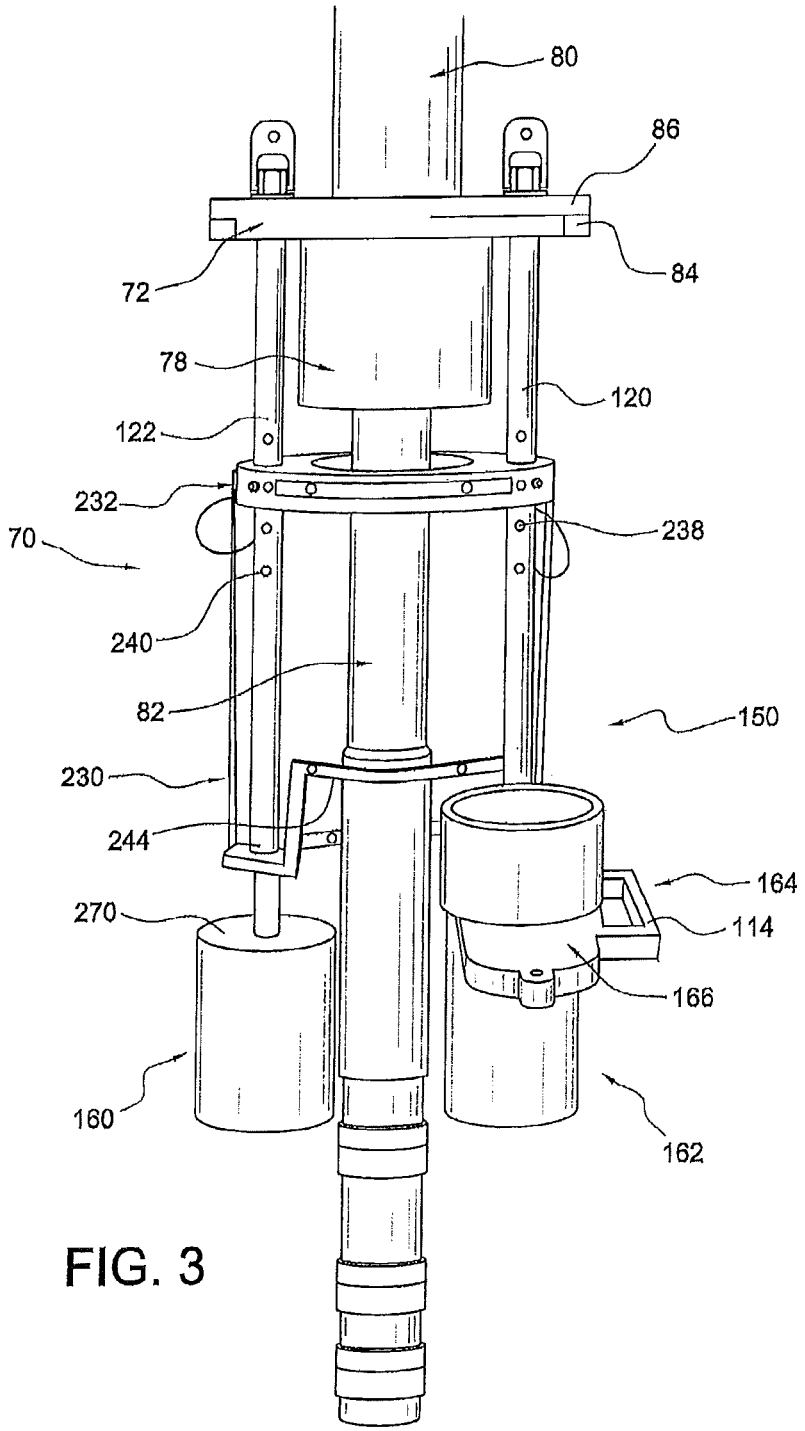
FIG. 3 illustrates a front view of the preferred embodiment of the invention illustrated in FIG. 2.
Figure 4:
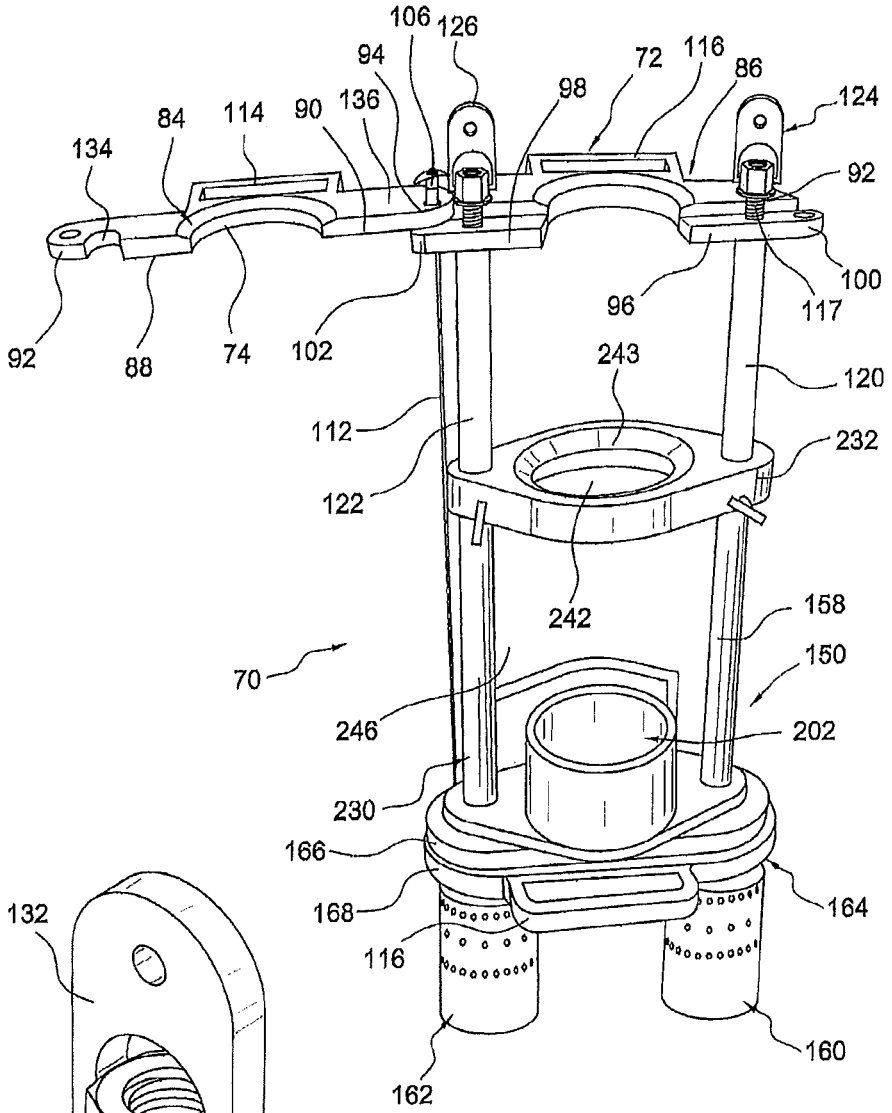
FIG. 4 illustrates a rear view of the preferred embodiment of the invention removed from the safety housing of FIG. 2.
Figure 5A:
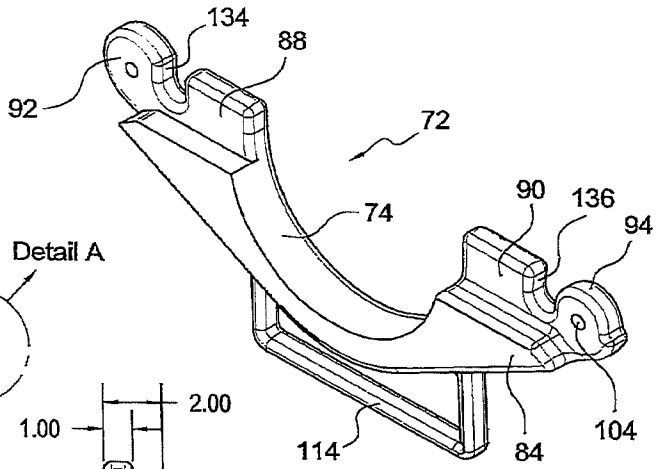
FIGS. 5A and 6A are perspective views of front and rear sections of a collar clamp portion of the tool catcher of FIGS. 2-4.
Figure 5D:
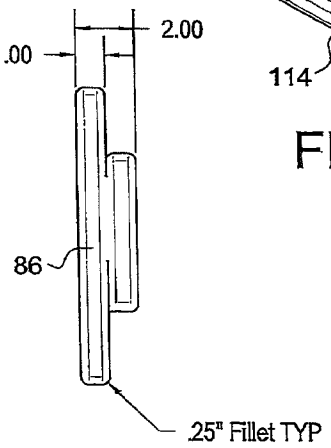
FIGS. 5B-D are top plan, detail and end views, respectively, of the collar clamp portion of FIG. 5A.
Figure 5B:
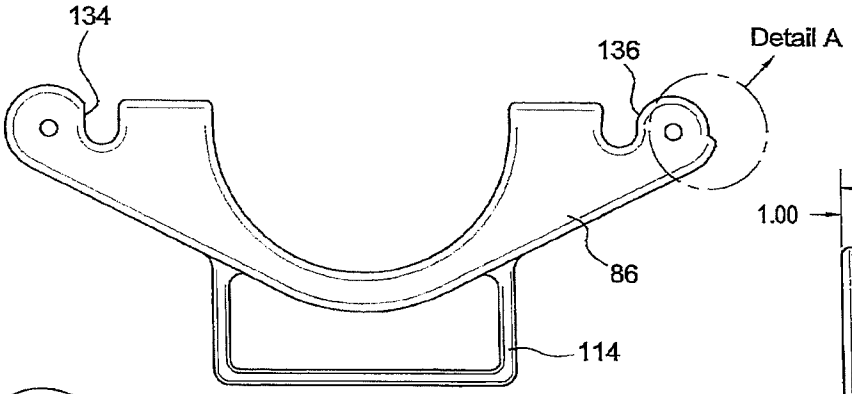
Figure 5C:
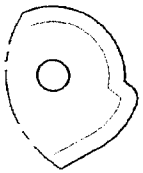
Figure 6A:
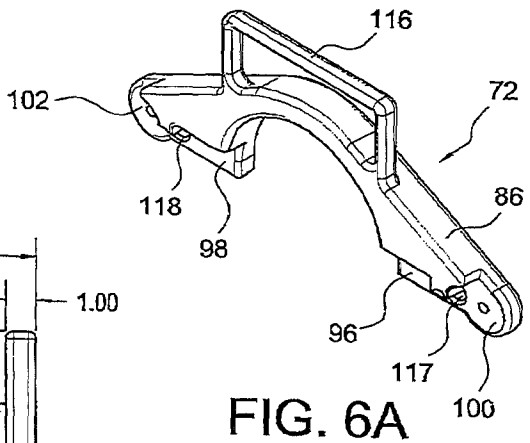

To prevent such damage, an external drill string trap assembly 70 in accordance with the present invention and best illustrated in FIGS. 2A-D, 3 and 4, is removably secured in the drilling rig, or derrick 24. Referring now to these illustrations, where FIG. 2A is a rear perspective view, FIG. 2B is a front elevation, FIG. 2C is a right side elevation, FIG. 2D is a sectional view taken along line D-D of FIG. 2C, and FIGS. 3 and 4 are perspective front and rear views, the external drill string trap assembly 70 includes an attachment ring, or upper collar clamp 72 which is configured to have a large central bore 74 sized to fit securely around a lower portion 76 and above a collar 78 of a tool string housing 80, which may be a conventional lubricator pipe for receiving a tool string or drill pipe segment 82. As depicted, and also seen in FIGS. 4-6, the attachment ring, or clamp 72 comprises first and second generally semicircular front and rear clamp sections 84 and 86 which incorporate overlapping flange portions having diametrically opposed overlapping hinge ears. The front clamp section 84 includes flanges 88 and 90 with respective ear portions 92 and 94 and the rear clamp section 86 includes flanges 96 and 98 with respective ear portions 100 and 102. Each ear incorporates a through aperture, such as aperture 104 illustrated in FIG. 5A, which is aligned with the aperture in a corresponding overlapping ear for receiving corresponding quick release locking pins 106 and 108 to lock the clamp in place around the housing 80 when the clamp is closed.

Figure 7:
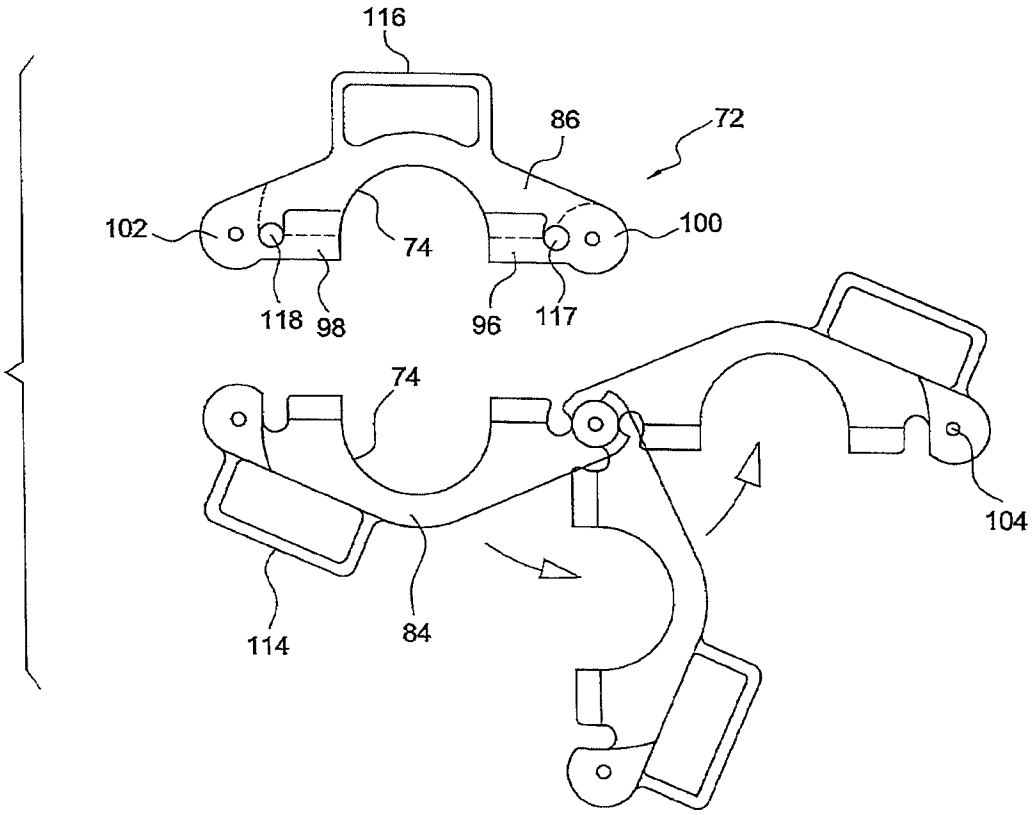
FIG. 7 is a diagrammatic bottom view of the collar clamp portion of the tool catcher of FIGS. 2-6, illustrating the pivotal motion of the collar clamp.
Figure 12:
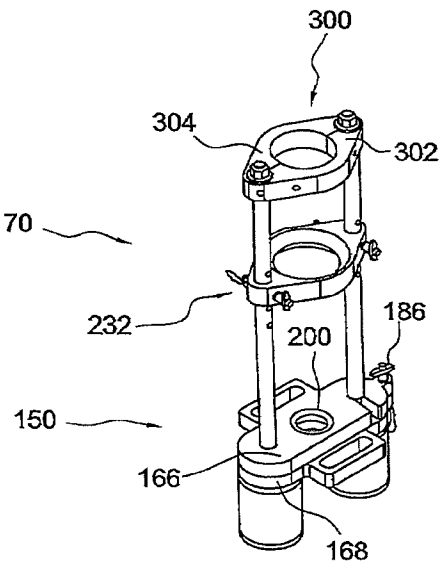
FIG. 12 is a diagrammatic perspective view of the assembly of FIGS. 9-11.
Figure 13:
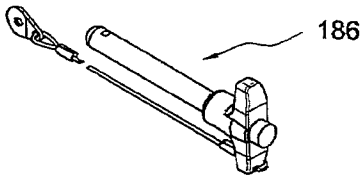
FIG. 13 is a perspective view of a securing pin for the stopping support assembly of the invention.
Figure 11:
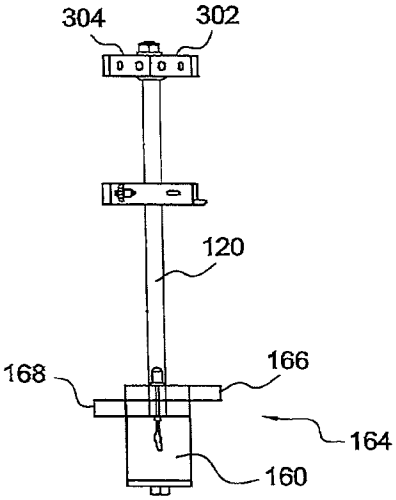
FIGS. 10 and 11 illustrate front elevation and side elevation views, respectively, of the assembly of FIG. 9.
Figure 9:
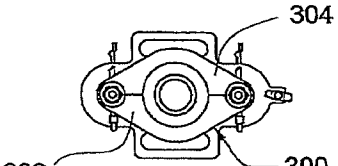
FIG. 9 is a diagrammatic top plan view of a stopping support assembly in accordance with a second embodiment of the invention.
Figure 10:
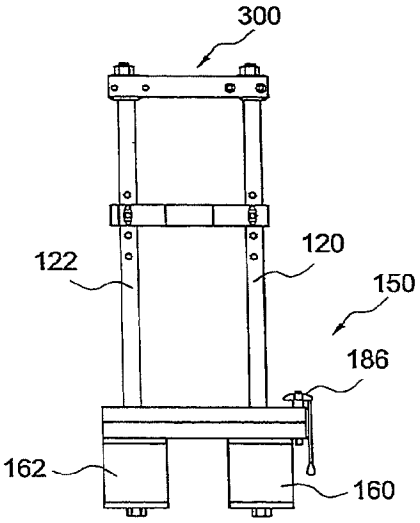

As illustrated in FIGS. 2-4, ears 94 and 102 are aligned when the clamp is closed and the flanges 90 and 96 are overlapping, so that when pin 106 is inserted through the respective apertures in these ears a hinge is formed for the clamp 72. The clamp is pivoted on pin 106 to open and then to close so central aperture 74 surrounds the lower portion 76 of the housing 80. The clamp is secured in place around the housing by inserting pin 108 through the aligned apertures in ears 92 and 100 when it is closed so that flange 88 overlaps flange 96. FIG. 7 is a diagrammatic bottom view illustration of the clamp 72, and illustrates the hinge motion of the front clamp section 86.

The housing 80 is typically aligned in a substantially vertical orientation in the drilling rig so that tool string components such as drill pipe segments 40 and 44 (FIG. 1A) or a downhole tool 56 and wireline 58 (FIG. 1B) are coaxially aligned along a substantially vertical drill or tool string axis 110. When the attachment ring or clamp 72 is installed on the housing 80, the central bore 74 of the clamp is coaxially aligned with the substantially vertical tool or drill string axis 110. The attachment ring halves 84 and 86 are releasably joined together by the pins 106 and 108, which preferably carry quick-release fasteners and may be attached to the clamp by suitable lanyards such as that illustrated at 112 in FIG. 4. As illustrated, each of the clamp portions 84 and 86 may incorporate a corresponding handle, such as respective handles 114 and 116, for ease in opening and closing the clamp.

Figure 8:
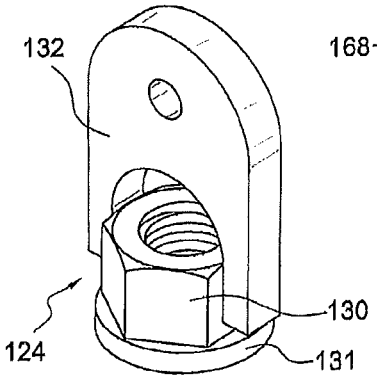
FIG. 8 is a perspective view of a lifting eye nut for the tool catcher of FIGS. 2-4.

The rear clamp portion 86 (see FIG. 6A) of the collar clamp 72 for the tool string trap assembly 70 has laterally spaced vertical bores 117 and 118 which pass through flanges 96 and 98, respectively, to receive and carry first and second depending connecting rods or rails 120 and 122 (see FIGS. 2E-2G) which extend downwardly on opposite sides of, and past the bottom end of, the housing collar 78, as illustrated in FIGS. 2A-2D, 3 and 4. Threaded fasteners, such as lifting nuts 124 and 126 (see FIG. 8) each incorporating a nut 130 and washer 131 secured, as by welding, to a lifting ring 132, are provided to secure the rods 120 and 122 to the clamp 72 by way of threads 133 on the top end of the rod. Optionally, a pair of first and second nuts (not shown) may be threaded down onto threads 133 on the top end of each rod, where the upper nut locks against the lower nut to prevent it backing off, during use. The washer 131 rests on the top surface of the rear clamp portion, while the front clamp portion 84 incorporates indentations 134 and 136 which receive the reduced-diameter upper end portions 138 (FIG. 2E) of the rods when the clamp is in the closed position. The connecting rods are arranged around the attachment ring, or collar clamp 72 to provide generally even support to the lower portions of the drill string trap assembly 70. For example, when two connecting rods are used as depicted, they should lie on opposite sides of the tool string housing.

Figure 14:
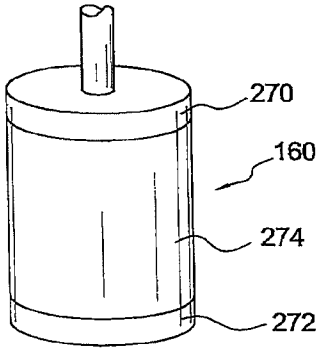
FIG. 14 is a perspective view of a crush cylinder for the stopping support assembly of the invention.
Figure 15:
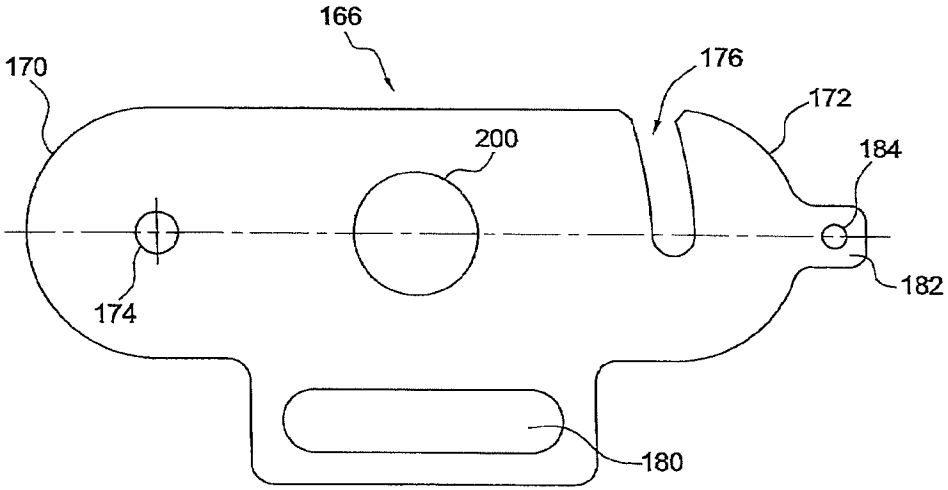
FIG. 15 is a diagrammatic bottom view of a catcher plate for the stopping support assembly of the invention.
Figure 16:
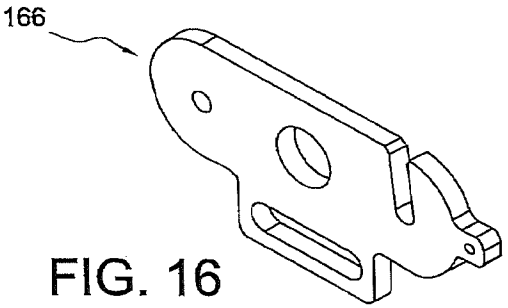
FIG. 16 is a perspective view of the catcher plate of FIG. 15.

Secured to and carried by the bottom ends of rods 120 and 122 is an openable and closeable tool stopping support assembly 150, illustrated in FIGS. 2A-2D, 3 and 4, and diagrammatically in FIGS. 9-15. This assembly includes a pair of crush cylinders 160 and 162 (FIG. 14) secured to the bottom ends of, and carried by, depending connecting rods 120 and 122, and a pivotally mounted catcher plate assembly 164 having upper and lower stopping plates 166 and 168, respectively, which are slideably and pivotally attached to the connecting rods and are supported by the respective crush cylinders. As illustrated in FIGS. 15 and 16, the upper plate 166, as viewed from the bottom, is generally rectangular with rounded ends 170 and 172 covering and generally conforming to the shapes of the crush cylinders 160 and 162, respectively. The end 170 includes an aperture 174 which receives rod 120, is pivotal around that rod, as illustrated in FIG. 3, and can slide up and down on the rod. The end 172 of the plate includes an arcuate slot 176 which receives and engages rod 122, and also allows the plate to slide up and down the rod. A handle 180 on one side of the plate 160 enables a user to move the plate from the forwardly open position illustrated in FIG. 3, to a closed position as illustrated in FIG. 4.

The lower plate 168 is similar to plate 166, and is also mounted on rod 120 for pivotal motion to engage its arcuate slot with rod 122 in its closed position. Both plates incorporate an ear 184 on one end, with the ear on plate 166 overlapping the ear on plate 168 in their closed positions, the overlapping apertures being adapted to receive a locking pin 186 (see FIGS. 9-13) to secure the plates in their closed positions. When mounted on the connecting rods, the plates may be rotated about the rods and positioned to a closed position to block the movement of a tool string through the housing 80 and past the position of the rotatable plates, or opened (FIG. 3) to allow the tool string to pass through the tool catcher plate assembly.

Figure 17:
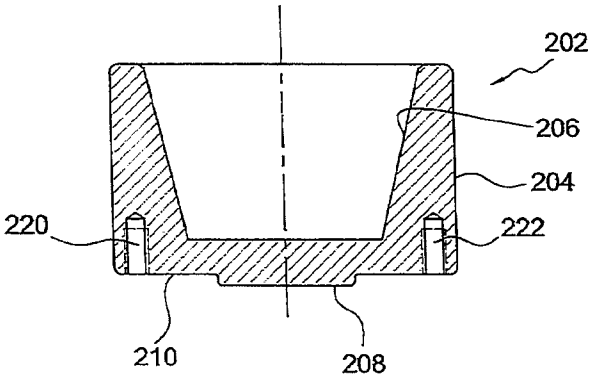
FIG. 17 is a sectional view of a catcher funnel for the catcher plate of FIG. 15.
Figure 18:
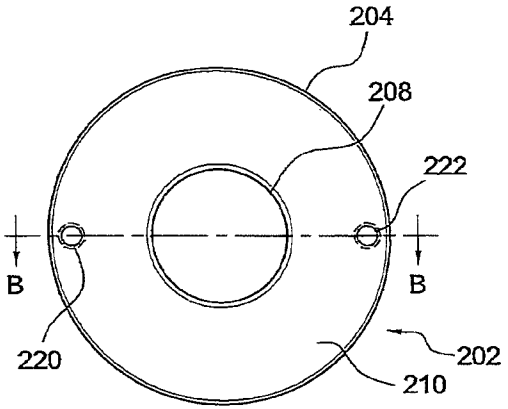
FIG. 18 is a bottom view of the catcher funnel of FIG. 17.
Figure 19:
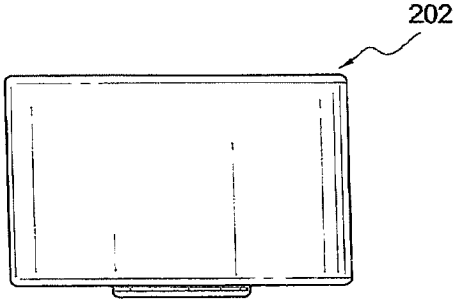
FIG. 19 is a side elevation view of the catcher funnel of FIG. 17.

The top plate 166 incorporates a central aperture 200 which is located to receive and secure a funnel cup 202 illustrated in FIGS. 2-4, and shown in greater detail in FIGS. 17-19, wherein FIG. 17 is a sectional view along line B-B of the bottom plan view of FIG. 18, and FIG. 19 is side elevation view of FIG. 18. The funnel has a cylindrical outer surface 204 and an inwardly sloping, generally conical inner surface 206. A central shoulder portion 208 is centered on its bottom exterior surface 210 to engage the aperture 200 on plate 166 to thereby center the conical surface 206 in the path of a tool string located in housing 80 when the stopping plates are closed. The funnel may be secured to the top plate 166 by screws or bolts engaging apertures 220 and 222 in the bottom of the funnel. The conical inner surface of the funnel directs the impact of a falling tool or tool string to the center of the catcher plate assembly 150 to distribute the force of the impact on the crush cylinders 160 and 162.

Mounted on the connecting rods, or rails, 120 and 122, above the catcher plate assembly 164 and forming part of the stopping support assembly 150, is an optional debris shield 230 (FIGS. 2A and 20-27), the bottom edge of which rests on the top of plate 166 and the top edge of which is secured to an entry guide ring or guide plate 232 (FIGS. 2A-J, 3 and 4). The guide ring may be a single plate, and is slideably mounted on the middle portion of the connecting rods 120 and 122 below the end of the tool string housing 80. The guide ring incorporates a pair of connector pins 234 and 236 which extend through apertures 237 in the edge of the ring to engage selected ones of a row of receptacles 238 and 240 aligned along the rods 120 and 122 (see FIG. 2E) to vertically position the guide ring on the rods. The guide ring includes a central hole 242 (FIG. 4) aligned with the tool string housing 80 and slightly larger than a tool string so that the tool string may pass freely through the guide ring. The edges 243 of this hole in the guide ring are beveled to help align the tool string with the guide ring and the tool string housing as the tool passes through them to the catcher plate assembly.

Figure 20:
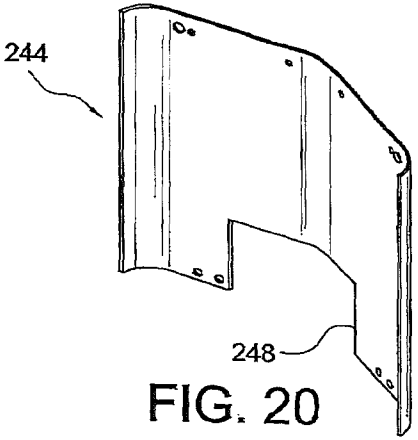
FIGS. 20-23 are perspective, front, rear, top and detail views, respectively, of a front debris shield for the stopping support assembly of the invention.
Figure 23:
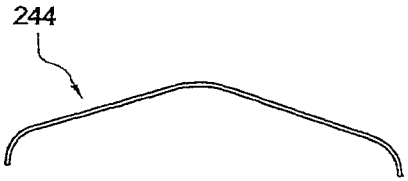
Figure 21:
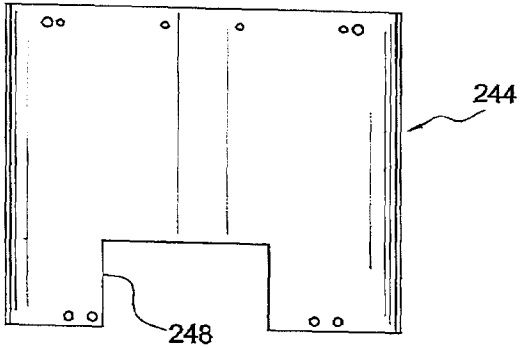
Figure 22:
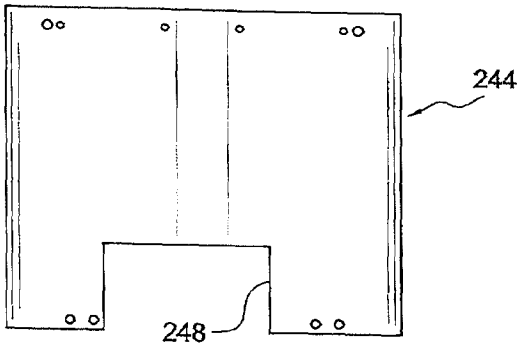
Figure 24:
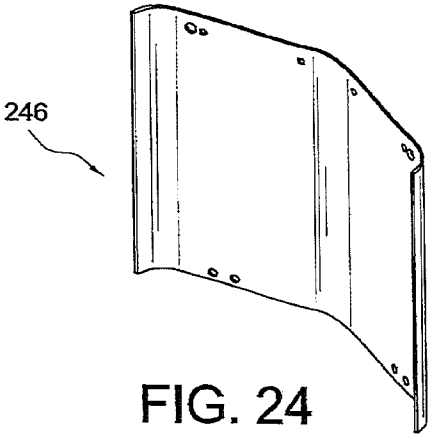
FIGS. 24-27 are perspective, front, rear, top and detail views, respectively, of a rear debris shield for the stopping support assembly of the invention.
Figure 27:
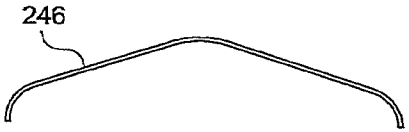
Figure 25:
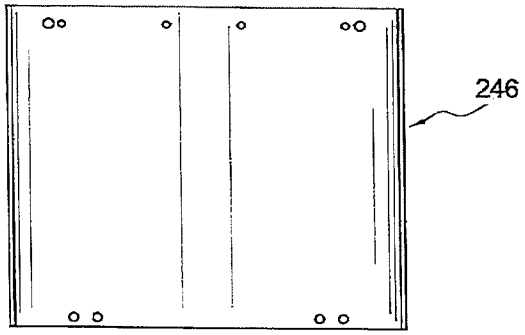
Figure 26:
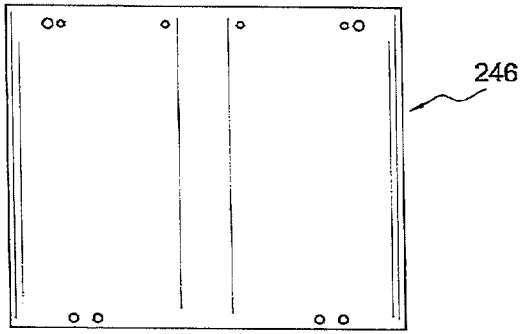
Figure 28:
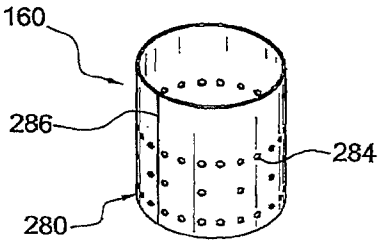
FIGS. 28 and 29 are perspective and side elevation views of a crush cylinder shield for the invention.
Figure 30:
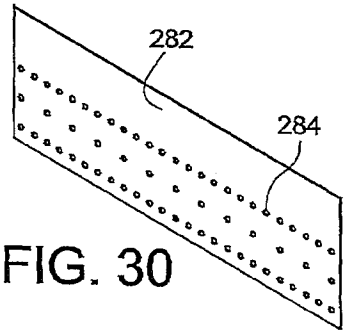
FIGS. 30 and 31 are perspective and plan views of a sheet material for fabricating the shield of FIG. 28.
Figure 31:
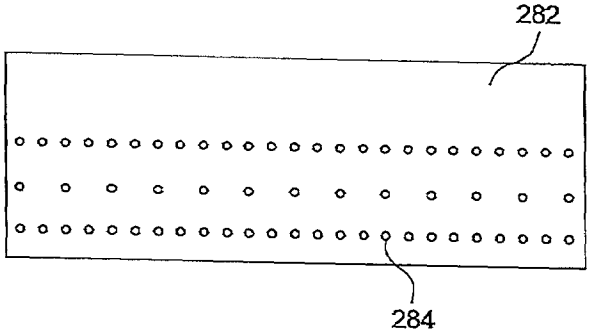
Figure 29:
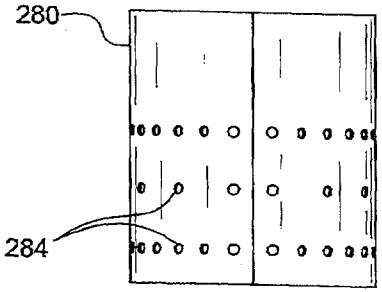

The debris shield 230 is fabricated from a transparent, strong material such as a $3/16^{th}$ inch thick sheet of Lexan, shaped to form a front panel 244 and a rear panel 246, the panels being curved as illustrated in FIGS. 20 and 24 to surround the funnel 202 and substantially cover the top plate 166 of the catcher plate assembly 164 to prevent pieces that might break from a falling tool when it strikes the catch plate assembly from scattering and injuring anyone nearby. The front panel 244 includes a cutout portion, or doorway, 248 to allow the catcher plate assembly and its mounted funnel to swing between its open and closed positions, as described above. The front and rear debris panels 244 and 246 are fastened to the guide ring by top curved U-braces 250 and 252, which may be fabricated from $3/16^{th}$ inch thick steel, using suitable fasteners such as screws 254, and are secured together at the bottom by curved U-braces 256 and 258 also fabricated from $3/16^{th}$ inch thick steel, by through bolts 260.

As best illustrated in FIG. 2D and in FIG. 14, the rods 120 and 122 extend through the catch plate assembly 164 and through the crush cylinders 160 and 162. Each crush cylinder consists of top and bottom crush washers 270 and 272 engaging the top and bottom walls of a cylindrical sacrificial energy absorbing cartridge 274, and is secured on its corresponding rod by a nut 276. The cartridge 274 may be a crushable material such as "FoamGlas" HLB insulation, available from Pittsburgh Corning, or other suitable material that is rigid enough to support the assembly 150 on the rods under normal conditions, but which is destroyed by the impact of a falling tool which strikes the funnel 202 with sufficient force to cause the catch plates to slide down on the rods so that the cartridges 274 absorb the kinetic energy of the tool.

Figure 32:
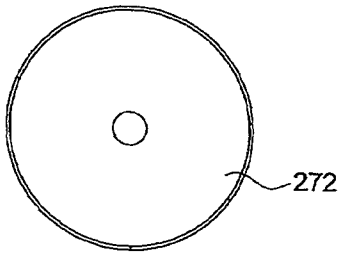
FIG. 32 is a plan view of a crush washer for the crush cylinder of FIG. 14.
Figure 33:
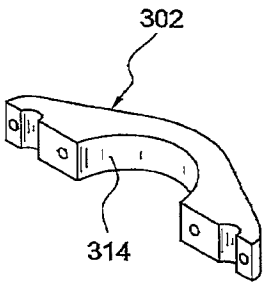
FIGS. 33-36 are perspective, sectional, front elevation, and end views, respectively, of a support collar segment for the second embodiment of the invention illustrated in FIGS. 9-12.
Figure 36:
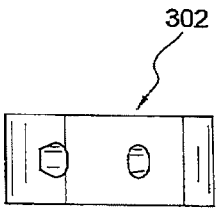
Figure 34:
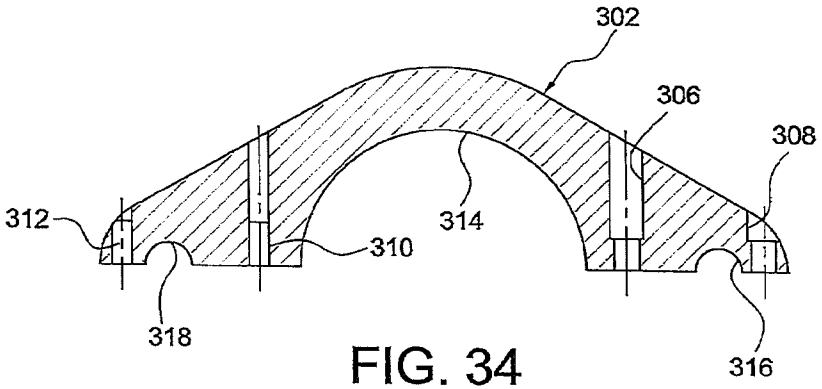
Figure 35:
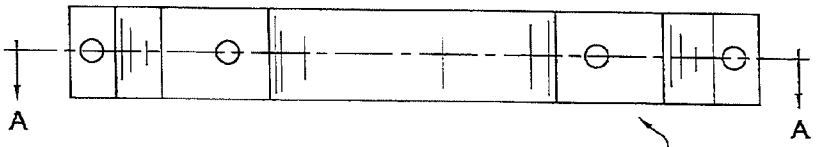

Surrounding the crushable cartridge 274 on each of the cylinders 160 and 162 is a cylindrical containment shield 280 formed from a sheet 282 of a material that is sufficiently strong to prevent debris from the cartridges 274 from scattering when they are crushed. The shield may be, for example, a 16 gauge sheet of stainless steel with spaced rows of perforations 284 to provide pressure release during a crushing operation, the opposite ends of the sheet being welded end-to-end along weld line 286 to form a cylinder. Preferably, the shield is secured to the top crush washer 270 and abuts the under surface of the plate 168 (FIG. 2D), and surrounds and slides over the lower washer 272 (FIGS. 2D and 32). It will be noted in the illustration of FIG. 2A, that the crush cylinder 160 has the containment shield 280 in place and removed from cylinder 162.

Referring again to FIGS. 9-12, the drill string trap assembly 70 here illustrated incorporates the openable and closeable tool stopping support assembly 150 described in detail hereinabove, but in this illustration has a different collar clamp. Instead of the pinned-together pivoting plates 84 and 86, which enable easy assembly and removal of the drill string trap as illustrated in FIGS. 2-4, this embodiment incorporates a collar clamp 300 having a pair of half-segments 302 and 304, one of which is illustrated at 302 in FIGS. 33-36, which are securely fastened about the housing 80 above the collar 78 to permanently mount the assembly 70 on the housing. Each segment includes a pair of through bores 306 and 308 on one end and a pair of threaded apertures 310 and 312 on the other end so that when the two segments face each other and the ends abut, bolts passing through the bores engage opposed threaded apertures to draw them together. The segments are generally C-shaped to define a central cavity 314 that surrounds housing 80 and is aligned with a drill string in housing 80, and include indentations 316 and 318 on each segment which surround and support the rods 120 and 122 when the segments are joined face to face.

The illustrated components comprising the tool catcher of the present invention (e.g., 70), with the exception of the crush cylinders, should be constructed of steel, or a similar strong and durable material and should be able to be disassembled for inspection and maintenance, including replacement of the crush cylinders, after a tool string impact. The parts of the invention should have thicknesses and dimensions suitable to absorb multiple tool string impacts without failure. The dimensions, number, and configuration of the various components of the invention may be altered as appropriate to fit the size and weight of the drilling apparatus. Such adjustments may be made without departing from the scope of the invention.

The following procedure has been found to be most effective for the use of the preferred embodiment tool catcher trap apparatus 70 of the present invention: while a tool string 82 is retracted into or above the tool string housing 80, the tool catcher of the present invention 70 is lifted to the tool string housing 80 and the attachment ring is placed over the lower end of the tool string housing and secured there. The operator should then verify that the tool catcher is securely attached to the tool string housing and properly aligned with the travel of the tool string. The rotatable catcher plates 166, 168 should be placed in the "closed" position and pinned in place to thereby prevent the tool string 82 from falling past the tool catcher unintentionally. The tool string 82 may then be lowered for inspection or use, with the rotatable catcher plates 166, 168 being moved to the "open" position (e.g., as illustrated in FIG. 3) whenever the tool string must be lowered beyond them, and returned to the "closed" position (e.g., as illustrated in FIGS. 2A and 4) for safety whenever the tool string is raised above them. It may be necessary for the operator to adjust the position of the tool string 82 as it is raised and lowered.

It will be appreciated by persons of skill in the art that the present invention provides a method for catching the end of tool string 82 in the event of an inadvertent loss of control, where the method includes the following method steps: positioning the tool string 82 for axial vertical motion through a vertical lubricator or housing 80; locating openable and closable catcher plate assembly 164 below housing 80; opening catcher plate assembly 164 to permit insertion of tool string 82 into a well 28 through housing 80; and closing catcher plate assembly 164 to prevent tool string 82 from passing through and out of housing 80. In the illustrated embodiment, when tool string slips or falls unintentionally, the fall is arrested and the kinetic energy of the falling tool string is absorbed by dissipating that kinetic energy (produced by loss of control of the tool string) when the tool string's lower or distal end strikes the closed catcher plate assembly 164. Preferably, the step of dissipating that kinetic energy includes directing the energy of the falling tool string through the catcher plate assembly 164 and into a crushable energy absorbing material (e.g., as carried within crush cylinders 160, 162).

Variations and modifications, including those described below, may be made without departing from the scope of the invention. Naturally, the sizes and dimensions may be varied from those depicted. A possible modification would be to add one or more attachment points for winches or other lifting means so that the tool catcher (e.g., 70), which may be heavy, may be lifted and positioned with mechanical assistance. These attachment points may be on the attachment ring, the connecting rods, or the guide ring. Another possible modification would be to vary the attachment means for the attachment ring. In particular, any method which allows the attachment ring to be quickly and easily attached and removed, while still providing a secure attachment, would be desirable in cases where the invention would need to be installed and removed quickly and/or frequently. Another possible modification would be to place padded and/or low-friction material on the guide ring to reduce the potential for damage to the tool string as it passes through the guide ring. Another possible modification would be to place padded material on the upper surface of the upper rotatable plate to reduce the potential for damage to the tool string if it contacts the rotatable plate.

In another embodiment of the invention, the crush cylinders 160, 162 in the exemplary embodiment may be replaced by a solid material, such as solid aluminum cylinders, to enable the device to carry a very large dead weight. In this case the tool catcher may be used with the tool string resting on the catch plates and funnel to serve as a safe support for the tool and related equipment.

Figure 37:
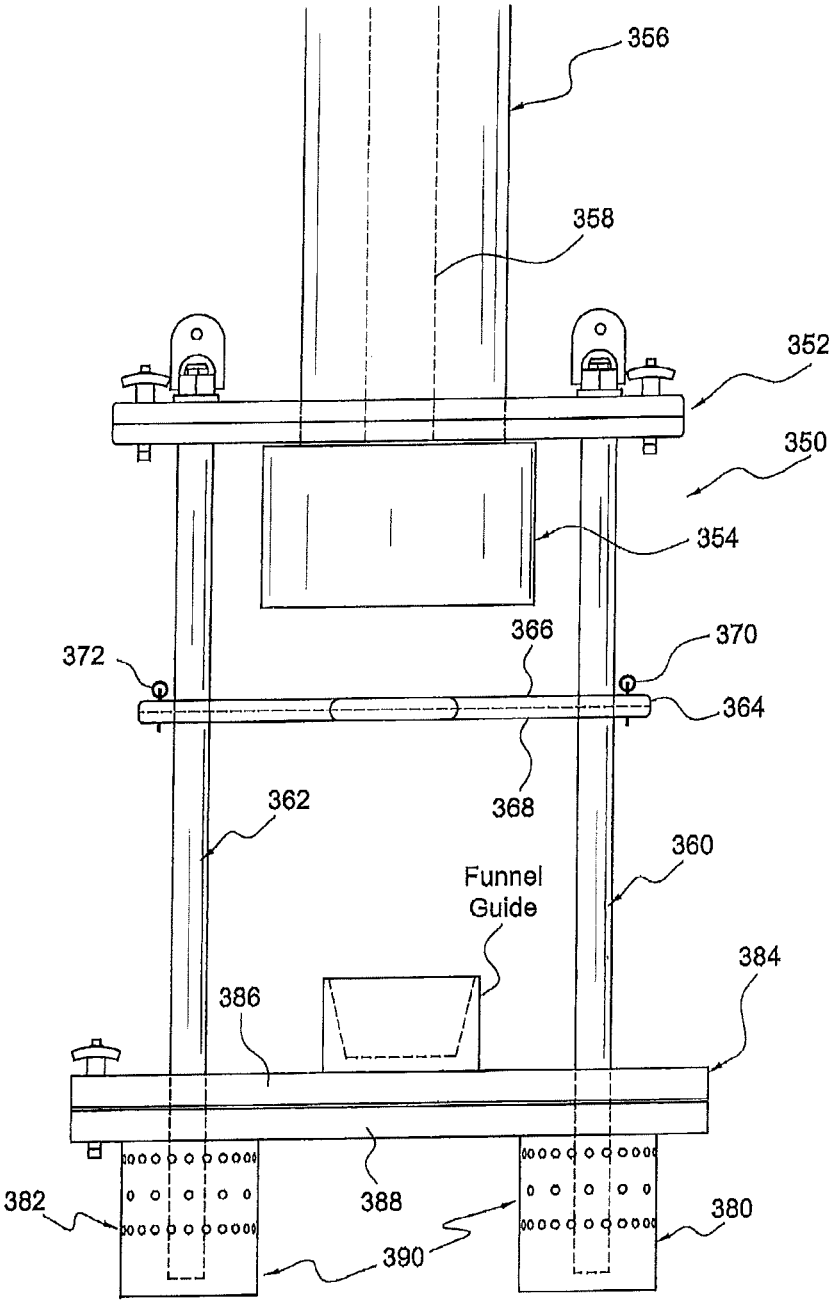
FIGS. 37 and 38 are diagrammatic illustrations of additional embodiments of the invention.

Still another embodiment of the invention facilitates a more permanent installation at a well head, and is a modification of the embodiment described with respect to FIGS. 9-12. In this case, as illustrated diagrammatically in FIGS. 37 and 38, a tool catcher 350 is constructed in accordance with the prior embodiments in that it includes a collar clamp 352 engaging the top of a collar portion 354 of a lubricator housing 356 through which a tool string 358 passes. The collar clamp secures depending support rods 360 and 362 on which an entry guide 364 is mounted to direct a tool string through the catcher assembly. In this case, the guide 364 is a two-piece unit, having two matching halves 366 and 368 with overlapping ears (not shown) that receive pins 370 and 372 that can be removed to allow removal of the entry guide or that can form hinges to allow the guide to remain on the rods but be swung out of the way of a tool string if desired. The entry guide may be vertically positioned on the rods by pins engaging corresponding apertures in the rods, as previously described, or held in place by a rod clamp, to be described.

Secured at the bottom of the rods is a pair of crush cylinders 380 and 382, as previously described, and a rotatable catcher plate assembly 384 that has two openable and closable catch plates 386 and 388, as previously described, resting on the tops of the crush cylinders. Since this embodiment is intended to be left on the well head, the distance 390 between the crush cylinders, and thus the distance between the rods 360 and 362, must be wider than the well head connection so that well equipment can be straddled by the tool catcher. This also requires a correspondingly wider collar clamp.

Figure 38:
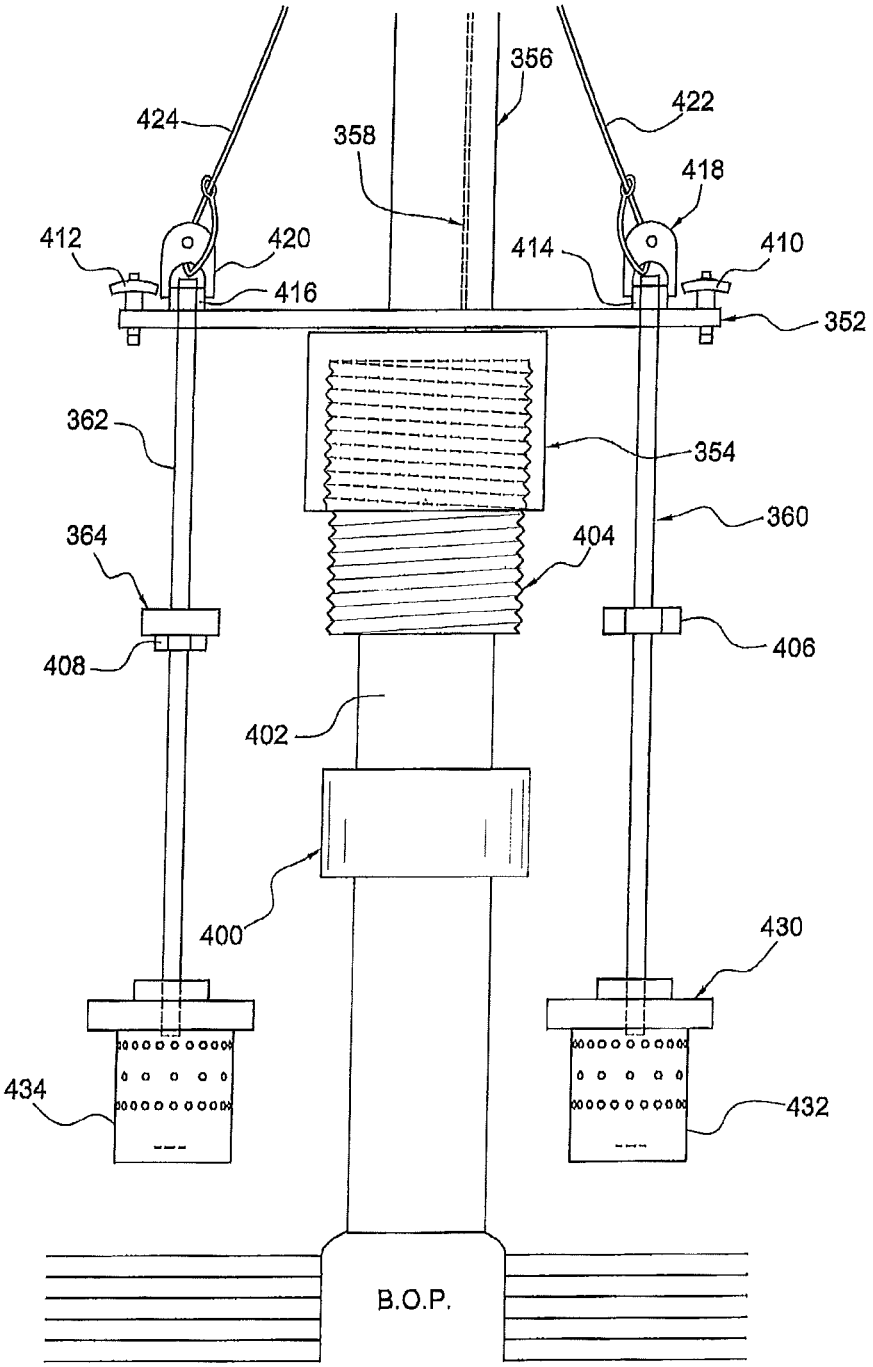

FIG. 38 illustrates the tool catcher lowered down over a well head 400 incorporating a casing 402 having top threads for receiving the collar 354. As shown, the entry guide 364 is opened to allow passage of the well head, with the guide being vertically positioned on the rods by rod clamps 406 and 408. As previously, the collar clamp 352 rests on collar 354; this may be a hinged two-part collar secured about the housing 356 by pins 410 and 412 as in prior embodiments, or may be a bolted clamp, also as previously described. As in prior embodiments, the rods 360 and 362 are secured in the collar clamp by lifting nuts 414 and 416, and corresponding lifting rings 418 and 420, to allow the assembly to be lifted and secured by lift cables 422 and 424. In this case, the catcher plate assembly has been opened and moved aside, and the spacing of the rods allows the crush cylinders 432 and 434 at the bottom of rods 360 and 362 to pass on either side of the well head.

Improved Tool Catcher with Lubricator Clamp Assembly

Figure 39:
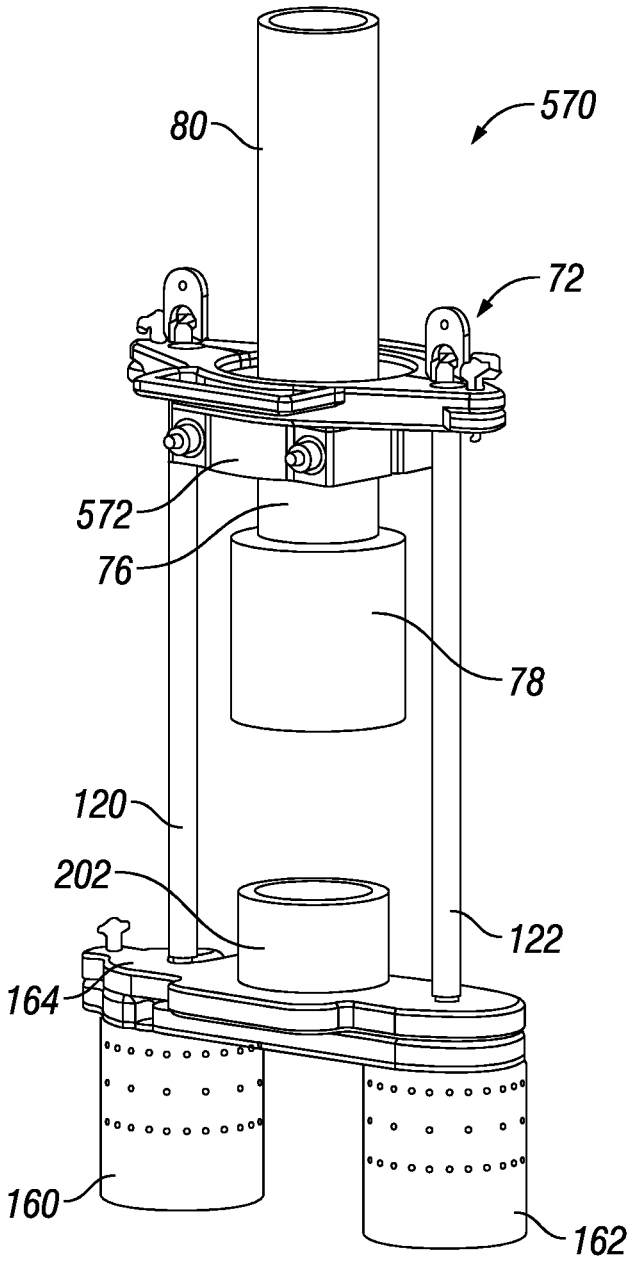
FIG. 39 illustrates a perspective view of another preferred embodiment of an improved tool catcher assembly clamped onto a safety housing or Lubricator with a Lubricator Clamp Assembly, in accordance with the present invention.

Turning now to FIGS. 39-43, an alternative embodiment or configuration for an improved external drill string trap assembly 570 in accordance with the present invention is removably secured in the drilling rig, or derrick 24. Referring now to FIG. 39 which is a front perspective view, FIG. 40A which is a front elevation and FIG. 40B which is a sectional view taken along line A-A of FIG. 40A, the improved external drill string trap assembly 570 includes an attachment ring, or upper collar clamp 72 which is configured to have a large central bore 74 sized to fit securely around a lower portion 76 and above a collar 78 of a tool string housing 80, which may be a conventional (e.g., "10K") lubricator pipe (6.5" O.D.×5.25" I.D.) for receiving a tool string or drill pipe segment 82. For the improved external drill string trap assembly 570, a lubricator clamp assembly 572 is configured to have a non-circular or slightly elliptical central bore 574 sized to clamp onto and securely clamp around and retain a lower portion 76 of the lubricator sidewall and above collar 78 of tool string lubricator or housing 80, which may be a conventional (e.g., "10K") lubricator pipe (6.5" O.D.×5.25" I.D.) for receiving a tool string or drill pipe segment 82.

Figure 6C:
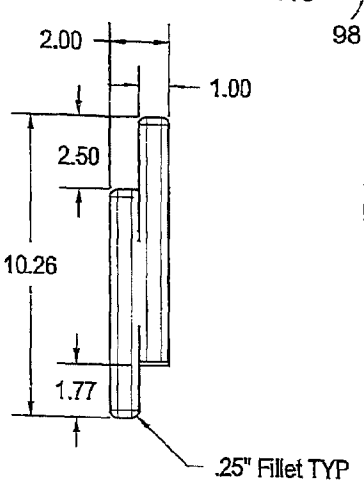
FIGS. 6B and 6C are top plan and end views of the collar clamp portion of FIG. 6A.
Figure 6B:
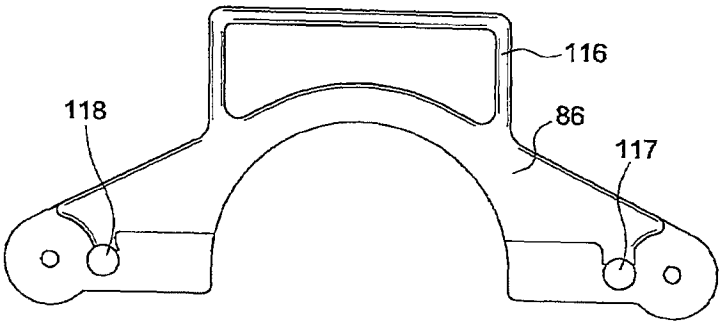
Figure 40A:
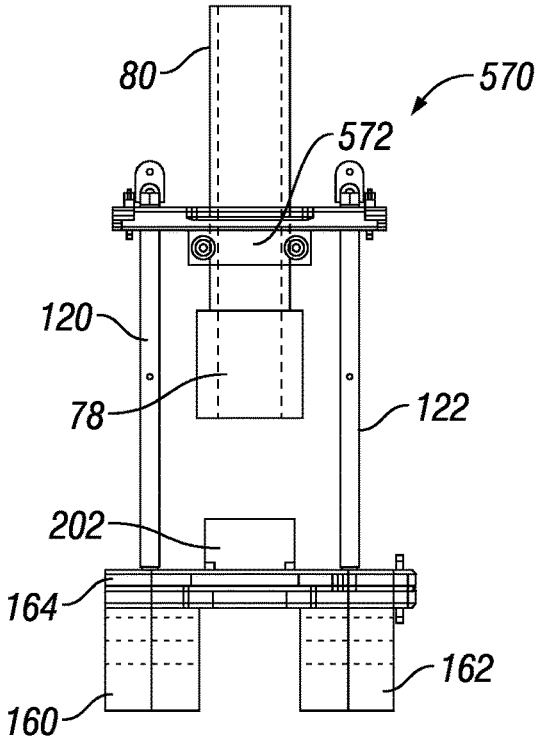
FIG. 40A is a front elevation of the improved tool catcher of FIG. 39.

As depicted in FIGS. 39 and 40A, and also seen in FIGS. 4-6, the attachment ring, or upper collar clamp 72 comprises first and second generally semicircular front and rear clamp sections 84 and 86 which incorporate overlapping flange portions having diametrically opposed overlapping hinge ears. The front clamp section 84 includes flanges 88 and 90 with respective ear portions 92 and 94 and the rear clamp section 86 includes flanges 96 and 98 with respective ear portions 100 and 102. Each ear incorporates a through aperture, such as aperture 104 illustrated in FIG. 5A, which is aligned with the aperture in a corresponding overlapping ear for receiving corresponding quick release locking pins 106 and 108 to lock the clamp in place around the housing 80 when the clamp is closed.

Recalling the illustrations of FIGS. 2-4, ears 94 and 102 are aligned when the clamp is closed and the flanges 90 and 96 are overlapping, so that when pin 106 is inserted through the respective apertures in these ears a hinge is formed for the clamp 72. The upper collar clamp 72 is pivoted on pin 106 to open and then to close so central aperture 74 surrounds the lower portion 76 of the lubricator or housing 80, just above lubricator clamp assembly 572. The upper collar clamp 72 is secured in place around the housing by inserting pin 108 through the aligned apertures in ears 92 and 100 when it is closed so that flange 88 overlaps flange 96. FIG. 7 is a diagrammatic bottom view illustration of upper collar clamp 72, and illustrates the hinge motion of the front clamp section 86. Threaded fasteners, such as lifting nuts 124 and 126 (see FIG. 8) each incorporating a nut 130 and washer 131 secured, as by welding, to a lifting ring 132, are provided to secure the rods 120 and 122 to the clamp 72 by way of threads 133 on the top end of the rod. Optionally, a pair of first and second nuts (not shown) may be threaded down onto threads 133 on the top end of each rod, where the upper nut locks against the lower nut to prevent it backing off, during use. The connecting rods are preferably 60 inches long and are arranged around the lubricator clamp assembly 572 to provide generally even support to the lower portions of the drill string trap assembly 570.

As noted above, lubricator or housing 80 is typically aligned in a substantially vertical orientation in the drilling rig so that tool string components such as drill pipe segments 40 and 44 (FIG. 1A) or a downhole tool 56 and wireline 58 (FIG. 1B) are coaxially aligned along a substantially vertical drill or tool string axis 110. When the attachment ring or upper collar clamp 72 is installed on the lubricator or housing 80 just above and in coaxial alignment with lubricator clamp assembly 572, the central bore 74 of upper collar clamp 72 is coaxially aligned with (a) the substantially vertical tool or drill string axis 110 and (b) the non-circular or slightly elliptical central bore 574 of lubricator clamp assembly 572. The upper collar clamp attachment ring halves 84 and 86 are releasably joined together by the pins 106 and 108, which preferably carry quick-release fasteners and may be attached to the clamp by suitable lanyards such as that illustrated at 112 in FIG. 4. As illustrated, each of the upper collar clamp portions 84 and 86 may incorporate a corresponding handle, such as respective handles 114 and 116, for ease in opening and closing the upper collar clamp 72.

Figure 40B:
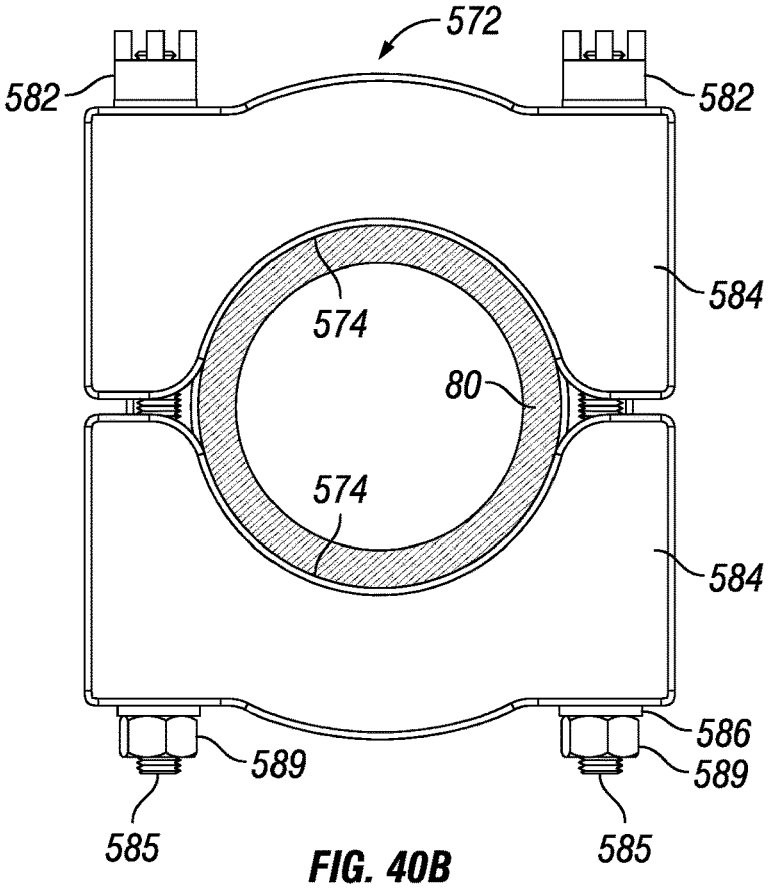
FIG. 40B is a sectional view taken along line A-A of FIG. 40A, showing a view from above of the Lubricator Clamp Assembly, installed upon the safety housing or Lubricator.

Referring now to FIGS. 39 and 40A-40B, where FIG. 39 is a front perspective view, FIG. 40A is a front elevation and FIG. 40B is a sectional view taken along line A-A of FIG. 40A, the improved external drill string trap assembly 570 includes lubricator clamp assembly 572 which is configured with a pair of substantially identical clamp members 584 which, when clamped together (e.g., as illustrated in FIGS. 39, 40A and 40B) define the slightly elliptical central bore 574 which is configured to fit securely around lower portion 76 and above collar 78 of tool string housing 80, which may be a conventional (e.g., "10K") lubricator pipe (6.5" O.D.× 5.25" I.D.) for receiving a tool string or drill pipe segment 82.

Figure 43:
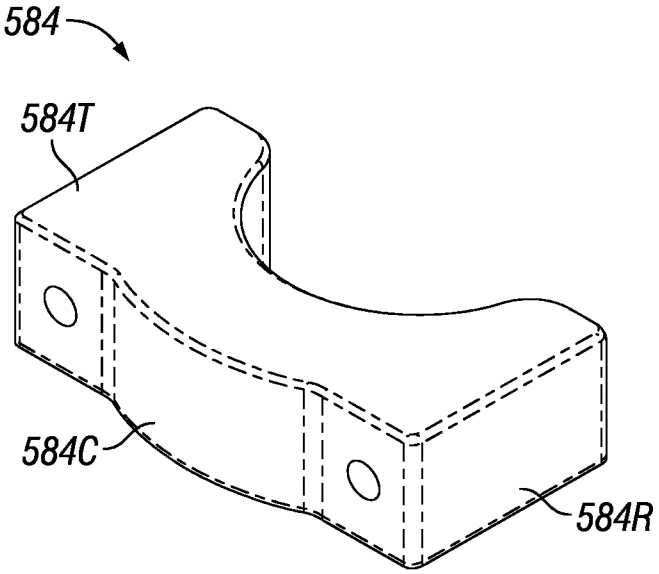
FIGS. 41-43 are detailed views of portions of the improved tool catcher' Lubricator Clamp Assembly of FIGS. 39-40B, in accordance with the present invention.
Figure 42:
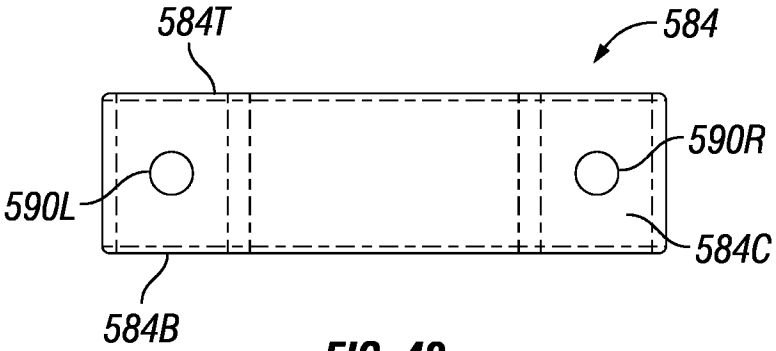
Figure 41:
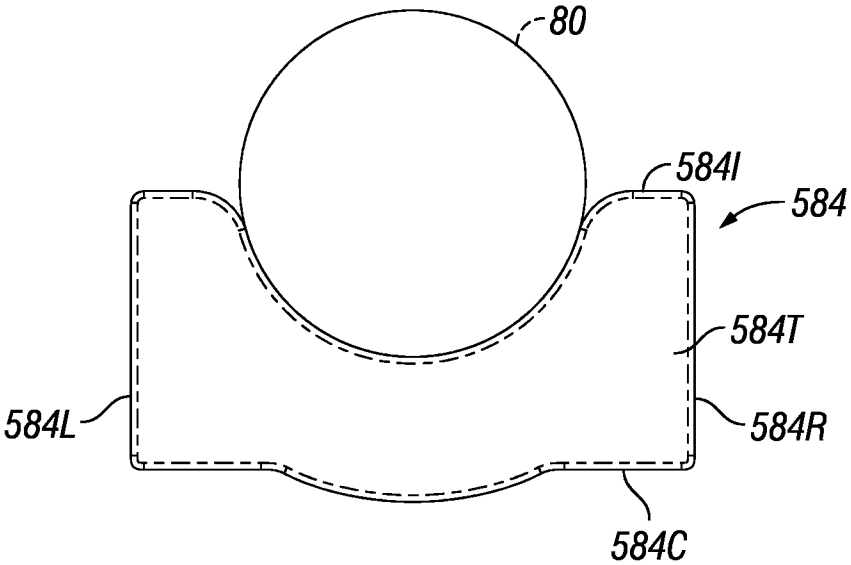

Each clamp member 584 is configured as illustrated in FIG. 41-43 as a machined, forged or cast solid unitary homogenous metal body, preferably fabricated from 6061-T651 aluminum, having opposing substantially parallel sidewalls 584L, 584R which are substantially rectangular, having a height of 3 inches and a length of 5.25 inches, where each sidewall terminates in an interior or inward facing surface 584I and an outward facing surface 584O. The parallel sidewalls 584L, 584R are also connected by a substantially planar top surface 584T which is spaced apart (e.g., by a thickness of 3.0 inches) from a parallel substantially planar bottom surface 584B. Each clamp member outward facing surface 584O defines a bulging outer wall segment having an overall length of 10.50 inches and terminating near the sidewalls in substantially coplanar straight wall segments separated by a central bulging wall segment having an outer radius of 6.0 inches, as best seen in FIG. 41. The bulging wall segment wraps around and supports a portion of inward facing surface 584I which defines half of the elliptical axial housing-receiving bore 574 (outline 80 illustrated in FIG. 41). When two clamp members are attached to define the elliptical central bore 574, the ellipse defined therein is preferably 6.500 inches by 6.510 inches, meaning the ellipse has a diameter in the long axis that is 0.010 inches for a 6.50" OD lubricator. For lubricator or housing outer diameters which differ from the illustrated embodiment, the ratio of the ellipse major axis departure from circular should be the same ratio, (e.g., 0.010 inches for 6.5 inches OD). This elliptical bore 574 creates a surprisingly effective static friction clamping condition where the lubricator clamp 572 grasps the exterior surface of the lubricator or housing 80, and resists movement under jarring dynamic forces to the tool string as demonstrated by engineering testing performed on behalf of the applicant.

Lubricator clamp assembly 572 includes a number of other components, as illustrated in FIG. 40B including first and second (e.g., ¾×10 inch long) stud members 585 having an overall length of 13 inches for the exemplary embodiment and being made from grade B7 steel or another suitable material. Each of the two stud members 585 are received in aligned left and right side bores 590L, 590R (0.81 inches in ID) defined through each of two clamp body members 584 so that the studs may, when used in connection with threaded fasteners 582, 589, bear on and apply significant clamping force to the planar outer wall segments of clamp members 584 as illustrated in FIG. 40B. The clamping force is preferably applied using, on one side, SuperNut style fasteners (such as Nord-lock STD fasteners, preferably model MT 0.750-10, nickel plated (shown at 582)). At the other end of each stud 585 a standard three quarter hex nut 589 is used in connection with a washer 586 each preferably also made from steel or another suitable material. Before the desired clamping force is applied, the Lubricator gap between facing inward facing surfaces 584I (shown in FIG. 4B) is preferably an easily seen gap (e.g., 0.25 inches) and as torque is applied, that gap is gradually diminished as the fastener is properly torqued to install lubricator clamp assembly 572 onto the exterior surface of lubricator 80.

Improved external drill string trap assembly 570, once installed with lubricator clamp assembly 572 onto housing 80 as shown in FIG. 40A, differs slightly from the embodiments illustrated in FIGS. 1-39 by providing a new clamping structure and method in that lubricator clamp assembly 572 is adjustable up or down the surface of housing or lubricator 80 and when installed and tightened (torqued) to its preselected clamping force, lubricator clamp assembly 572 does not slide down significantly when exposed to the shocks or jarring forces generated when, for example, a tool string is dropped. Comparing the Improved trap apparatus of FIGS. 39-43 with the embodiments described above, persons of skill in the art will understand that the lubricator clamp assembly 572 may be used instead of guide plate 232, as discussed above.

Lubricator clamp assembly 572 provides a secondary surface for the tool catcher to rest upon that is not on top of the lubricator collar 354. This allows the lubricator collar to be rotated for attaching to the top of the BOP 404 without having to remove or lift up the tool catcher or move the tool catcher out of the way. This allows users to more quickly and economically install the tool catcher assembly (e.g., 570), thereby enhancing safety and convenience. Incorporating lubricator clamp assembly 572 increases the efficiency and safety of the tool catcher by allowing the tool catcher to stay in place during the attachment and removal of the lubricator from the BOP which typically happens multiple times on a well site.

Persons of skill in the art will appreciate that the tool with the lubricator clamp assembly 572 will resist impact forces imparted on the tool catcher in the event a failure occurs. The nut tensioner features of lubricator clamp assembly 572 provide a mechanism which can be adjusted with a torque wrench and therefore, in use, exhibits less variation in clamping force than a standard nut installed with a torque wrench. The nut tensioner insures that there will be sufficient clamping force to prevent slippage of the housing during an impact without imparting too high a clamping force to overstress the lubricator housing (e.g., 80), a critical consideration especially when operating at high pressures on a well site. It should be noted that if the lubricator clamp assembly 572 is installed improperly and with an excessive amount of clamping force, it could cause failure to the lubricator 80 when under pressure at the well site, so the ability of the user to apply a calibrated amount of torque to bolts 582 and 589 is an important safety advantage. The elliptical shape of the internal diameter surfaces (non-circular or slightly elliptical central bore 574) of lubricator clamp assembly 572 reduces the peak stress experienced by the lubricator housing's external sidewall surfaces. The surprisingly effective ellipse shape was confirmed to be effective using FEA analysis and frictional analysis, after many trials.

Guide plate 232 is not necessary with the preferred embodiment of the tool catcher assembly 570 if it is used in a manner which allows the tool catcher to stay on the lubricator 80 during attachment and removal from the BOP because guide plate 232 would be in the way during that installation process. A guide plate (e.g., like 232) could be used by a well site operator, if needed, in the event that the well site operator needed to remove the tool catcher from the lubricator 80 before and after the lubricator is attached to the BOP. This allows additional flexibility for the tool catcher assemblies (e.g., 570) of the present invention. Guide plate 232 could be modified with an open hinging feature allowing part of it to swing out of the way in which case it could be used with the tool catcher embodiments described and illustrated herein during attachment to the BOP.

Lubricator clamp assembly 572 as illustrated in FIGS. 39-43 is configured to resist the loads imparted on the tool catcher in the event of a rope or rope socket failure. The two studs 585 and nut tensioners described above allow the user to install lubricator clamp assembly 572 on housing 80 with a calibrated amount of force controlled by torque applied to the stud and nut tensioner assembly. The lubricator clamp assembly 572 relies primarily on friction to prevent slippage of the tool catcher when impacted by (for example) an 800 lb tool that has fallen 10 ft. The load imparted on the lubricator clamp assembly 572 from that impact is approximately 17,500 lb/ft and the clamp force needed to prevent slippage was calculated to be over 28,000 lb/ft for static friction and 37,000 lb/ft for dynamic friction. The dynamic clamp force was chosen to be especially conservative, since safety is such an important issue. Applicants work in evaluating the design to determine the maximum stresses and deflections experienced by the lubricator clamp assembly 572 and lubricator 80 were conservative and provided significant safety margins (e.g., for clamp members 584 having a 3 inch thick solid body fabricated from 6061-T651 aluminum with a minimum yield of 35,000 psi and for a lubricator 80 made from 8630M steel with a minimum yield of 75,000 psi). For applicant's testing and development work, a load of 18,609 lb/ft (of torque) was applied at the first and second stud locations on lubricator clamp assembly 572 and the lubricator clamp assembly 572 was restrained from moving in the axial direction on the lubricator 80. The ends of the lubricator were fully retained in the test indicating that the elliptical shape and surface areas defined in the opposing inward facing surfaces 584I provided interior clamping surfaces that were surprisingly well suited to clamp and retain the tool string, thereby providing safety for the operators. In the exemplary embodiment, the "super bolt" nut style tensioners 582 were, as noted above, Nordlock brand STD, part number MT 0.750-10 nuts with three quarter inch IDs and preferably 10 threads per inch, to correspond with the threaded external surface of each stud 585. This embodiment is described as an example of a suitable configuration for applying the required (but not excessing) clamping force, and persons of skill in the art will readily be able to identify other stud and bolt combinations which may be used to provide suitable clamping force.

Persons of skill in the art will appreciate that improved external trap apparatus 570 provides an apparatus and method for safely controlling drilling tool string components during oil field drilling operations. Improved external trap apparatus or tool catcher 570 includes a collar clamp 72 affixed to a drilling tool string lubricator 80 and configured with laterally spaced first and second vertical rails 120, 122 depending therefrom and preferably having a length of 60 inches or 5 feet. Lubricator or housing 80 carries a lubricator clamp assembly 572 which is affixed to Lubricator 80 above collar 78, with inward clamping surfaces defining a non-circular or slightly elliptical central bore 574. Laterally spaced first and second vertical rails 120, 122 are configured to support a reinforced catcher plate assembly 164 carrying tool-end receiving funnel receptacle 202 and first and second energy absorbing crush cylinders (e.g., 160, 162) which dampen, cushion or absorb the jarring forces received in the funnel receptacle. When drill string 82 is raised or withdrawn from the well 28, the funnel receptacle 202 can be rotated into coaxial alignment to catch the drill string's end or downhole tool, in the event of an inadvertent loss of control of the drill string 82.

The foregoing describes preferred embodiments of drill string trapping apparatus and methods, and it is believed that other modifications, variations and changes will be suggested to those skilled in the art in view of the teachings set forth herein. It is to be understood that all such variations, modifications and changes are believed to fall within the scope of the present invention as set forth in the following claims.

What is claimed is:

1. An external tool string trap assembly for mounting on a bottom end of a drilling tool string housing, comprising:

a collar clamp mounted on corresponding top ends of first and second vertical rails that are laterally spaced apart, said collar clamp being securable to said tool string housing;

a lubricator clamp assembly secured to said tool string housing with a clamp force applied via a clamp force adjusting tensioner and having a non-circular internal surface;

first and second crush cylinders affixed to corresponding bottom ends of said first and second vertical rails;

an openable and closable catcher plate assembly pivotally and slideably attached to said first and second vertical rails and supported by said first and second crush cylinders, wherein said openable and closable catcher plate assembly permits or restricts insertion of a tool string when said catcher plate assembly is opened or closed, respectively;

a funnel receptacle mounted on said catcher plate assembly, and movable into coaxial alignment along with the tool string housing when the catcher plate assembly is moved from an open to closed position, wherein when said tool string falls and strikes said funnel receptacle with a force, said catcher plate assembly slides down on said first and second vertical rails such that kinetic energy dissipated by said falling tool string is directed into said first and second crush cylinders by way of said catcher plate assembly, and is absorbed by said first and second crush cylinders, and wherein further the first and second crush cylinders are affixed to the corresponding bottom ends of the first and second vertical rails by corresponding connecting rods and secured to the respective rod with a corresponding nut.

2. The assembly of claim 1 wherein the lubricator clamp assembly is secured below the collar clamp.

3. The assembly of claim 1, wherein said lubricator clamp assembly comprises a pair of clamp members each having an inward facing surface defining an elliptical central bore.

4. The assembly of claim 1, wherein said collar clamp includes first and second clamp portions hingedly connected to each other to close around said housing for mounting and removing the collar clamp assembly.

5. The assembly of claim 1, wherein said catcher plate assembly includes upper and lower plates each pivotably mounted at one end of one of said rails and engagable with one end of the other of said rails when in the closed position.

6. The assembly of claim 1, wherein said rails are spaced apart sufficiently to allow said assembly to straddle a well head, to enable permanent connection of said assembly to said housing.

7. The assembly of claim 1, wherein said lubricator clamp assembly further comprises first and second clamp members fastenable to the tool string housing to provide a safety assembly, the safety assembly further including:

a guide plate mounted on said rails below and coaxially aligned with said tool string housing;

wherein said collar clamp includes first and second clamp portions hingedly connected to each other to close around said housing for mounting and removing; and wherein said catcher plate assembly includes upper and lower plates each pivotably mounted at one end of one of said rails and engagable with one end of the other of said rails when in the closed position.

8. The assembly of claim 7, wherein said rails are spaced apart sufficiently to allow said assembly to straddle a well head, to enable permanent connection of said assembly to said housing, and wherein said guide plate comprises a pair of opposed plate segments hingedly mounted on said rails.

9. The assembly of claim 1 wherein the tensioner of the lubricator clamp includes first and second stud members and threaded fasteners for each stud member, so as when torque is applied, the clamping force is produced and secures the lubricator clamp onto the tool string housing.

10. The assembly of claim 9 wherein the threaded fasteners comprise hex nuts and further include a washer for each nut.

11. An external tool string trap assembly for mounting on a bottom end of a drilling tool string housing, comprising:

a collar clamp mounted on corresponding top ends of first and second vertical rails that are laterally spaced apart, said collar clamp being securable to said tool string housing;

a lubricator clamp assembly clamped to said tool string housing with a clamp force applied via a clamp force adjusting tensioner and having a non-circular internal surface wherein further the tensioner includes first and second stud members and threaded fasteners for each stud member;

first and second crush cylinders affixed to corresponding bottom ends of said first and second vertical rails;

an openable and closable catcher plate assembly pivotally and slideably attached to said first and second vertical rails and supported by said first and second crush cylinders, wherein said openable and closable catcher plate assembly permits or restricts insertion of a tool string when said catcher plate assembly is opened or closed, respectively;

a funnel receptacle mounted on said catcher plate assembly, and movable into coaxial alignment along with the tool string housing when the catcher plate assembly is moved from an open to closed position, wherein when said tool string falls and strikes said funnel receptacle with a force, said catcher plate assembly slides down on said first and second vertical rails such that kinetic energy dissipated by said falling tool string is directed into said first and second crush cylinders by way of said catcher plate assembly, and is absorbed by said first and second crush cylinders, and wherein further the first and second crush cylinders are affixed to the corresponding bottom ends of the first and second vertical rails by corresponding connecting rods and secured to the respective rod with a corresponding nut.

12. An external tool string trap assembly for mounting on a bottom end of a drilling tool string housing, comprising:

a collar mounted on corresponding top ends of first and second vertical rails that are laterally spaced apart, said collar clamp being securable to said tool string housing;

a lubricator clamp assembly clamped to said tool string housing with a clamp force applied via a clamp force adjusting tensioner and having a non-circular internal surface;

first and second crush cylinders affixed to corresponding bottom ends of said first and second vertical rails;

an openable and closable catcher plate assembly pivotally and slideably attached to said first and second vertical rails and supported by said first and second crush cylinders, wherein said openable and closable catcher plate assembly permits or restricts insertion of a tool string when said catcher plate assembly is opened or closed, respectively;

and a funnel receptacle mounted on said catcher plate assembly, and movable into coaxial alignment along with the tool string housing when the catcher plate assembly is closed, wherein when said tool string falls and strikes said funnel receptacle with a force, said catcher plate assembly slides down on said first and second vertical rails such that kinetic energy dissipated by said falling tool string is directed into said first and second crush cylinders by way of said catcher plate assembly, and is absorbed by said first and second crush cylinders;

wherein further, said crush cylinders consist of top and bottom crush washers that engage top and bottom walls of a cylindrical sacrificial energy absorbing cartridge, wherein said cartridge may be a crushable material that is rigid to support said assembly on said corresponding first and second vertical rails under normal conditions, and is destroyed by absorbing said kinetic energy of said falling tool string.

* * * * *